US009053675B2

(12) United States Patent
Miyake et al.

(10) Patent No.: US 9,053,675 B2
(45) Date of Patent: Jun. 9, 2015

(54) SIGNAL LINE DRIVER CIRCUIT AND LIQUID CRYSTAL DISPLAY DEVICE

(71) Applicant: Semiconductor Energy Laboratory Co., Ltd., Atsugi-shi, Kanagawa-ken (JP)

(72) Inventors: Hiroyuki Miyake, Kanagawa (JP); Seiko Inoue, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 181 days.

(21) Appl. No.: 13/667,222

(22) Filed: Nov. 2, 2012

(65) Prior Publication Data

US 2013/0120229 A1 May 16, 2013

(30) Foreign Application Priority Data

Nov. 11, 2011 (JP) ..... 2011-247262

(51) Int. Cl.
*G09G 3/36* (2006.01)

(52) U.S. Cl.
CPC ..... *G09G 3/3648* (2013.01); *G09G 2300/0469* (2013.01); *G09G 3/3685* (2013.01); *G09G 2300/0434* (2013.01); *G09G 2320/046* (2013.01); *G09G 2330/022* (2013.01)

(58) Field of Classification Search
CPC ..... G09G 3/30; G09G 3/36; G09G 5/00; H01L 21/44; H01L 29/786
USPC ..... 345/76, 100, 173–174, 92, 204, 212, 345/99; 257/43
See application file for complete search history.

(56) References Cited

U.S. PATENT DOCUMENTS

| | | | | |
|---|---|---|---|---|
| 5,731,856 | A | 3/1998 | Kim et al. | |
| 5,744,864 | A | 4/1998 | Cillessen et al. | |
| 6,294,274 | B1 | 9/2001 | Kawazoe et al. | |
| 6,563,174 | B2 | 5/2003 | Kawasaki et al. | |
| 6,727,522 | B1 | 4/2004 | Kawasaki et al. | |
| 6,856,307 | B2 * | 2/2005 | Osame et al. | 345/98 |
| 7,049,190 | B2 | 5/2006 | Takeda et al. | |

(Continued)

FOREIGN PATENT DOCUMENTS

| | | | |
|---|---|---|---|
| CN | 101320183 | A | 12/2008 |
| CN | 101527128 | A | 9/2009 |

(Continued)

OTHER PUBLICATIONS

Asakuma, N. et al., "Crystallization and Reduction of Sol-Gel-Derived Zinc Oxide Films by Irradiation With Ultraviolet Lamp," Journal of Sol-Gel Science and Technology, 2003, vol. 26, pp. 181-184.

(Continued)

*Primary Examiner* — Lun-Yi Lao
*Assistant Examiner* — Johny Lau
(74) *Attorney, Agent, or Firm* — Fish & Richardson P.C.

(57) ABSTRACT

To prevent malfunctions from occurring. A shift register, a selection circuit having a function of determining which a first pulse signal or a second pulse signal is output at the same potential level as a pulse signal input from the shift register, and a plurality of driving signal output circuits each having functions of generating and outputting a driving signal are provided. Each of the plurality of driving signal output circuits includes a latch unit, a buffer unit, and a switch unit for controlling rewriting of data stored in the latch unit.

14 Claims, 20 Drawing Sheets

(56) References Cited

U.S. PATENT DOCUMENTS

| | | | |
|---|---|---|---|
| 7,061,014 | B2 | 6/2006 | Hosono et al. |
| 7,064,346 | B2 | 6/2006 | Kawasaki et al. |
| 7,105,868 | B2 | 9/2006 | Nause et al. |
| 7,211,825 | B2 | 5/2007 | Shih et al |
| 7,282,782 | B2 | 10/2007 | Hoffman et al. |
| 7,297,977 | B2 | 11/2007 | Hoffman et al. |
| 7,323,356 | B2 | 1/2008 | Hosono et al. |
| 7,385,224 | B2 | 6/2008 | Ishii et al. |
| 7,402,506 | B2 | 7/2008 | Levy et al. |
| 7,411,209 | B2 | 8/2008 | Endo et al. |
| 7,453,065 | B2 | 11/2008 | Saito et al. |
| 7,453,087 | B2 | 11/2008 | Iwasaki |
| 7,462,862 | B2 | 12/2008 | Hoffman et al. |
| 7,468,304 | B2 | 12/2008 | Kaji et al. |
| 7,501,293 | B2 | 3/2009 | Ito et al. |
| 7,674,650 | B2 | 3/2010 | Akimoto et al. |
| 7,724,231 | B2 | 5/2010 | Nakao et al. |
| 7,732,819 | B2 | 6/2010 | Akimoto et al. |
| 2001/0046027 | A1 | 11/2001 | Tai et al. |
| 2002/0056838 | A1 | 5/2002 | Ogawa |
| 2002/0132454 | A1 | 9/2002 | Ohtsu et al. |
| 2003/0189401 | A1 | 10/2003 | Kido et al. |
| 2003/0218222 | A1 | 11/2003 | Wager, III et al. |
| 2004/0038446 | A1 | 2/2004 | Takeda et al. |
| 2004/0127038 | A1 | 7/2004 | Carcia et al. |
| 2005/0017302 | A1 | 1/2005 | Hoffman |
| 2005/0199959 | A1 | 9/2005 | Chiang et al. |
| 2006/0022908 | A1* | 2/2006 | Schwanenberger et al. .... 345/76 |
| 2006/0035452 | A1 | 2/2006 | Carcia et al. |
| 2006/0043377 | A1 | 3/2006 | Hoffman et al. |
| 2006/0091793 | A1 | 5/2006 | Baude et al. |
| 2006/0108529 | A1 | 5/2006 | Saito et al. |
| 2006/0108636 | A1 | 5/2006 | Sano et al. |
| 2006/0110867 | A1 | 5/2006 | Yabuta et al. |
| 2006/0113536 | A1 | 6/2006 | Kumomi et al. |
| 2006/0113539 | A1 | 6/2006 | Sano et al. |
| 2006/0113549 | A1 | 6/2006 | Den et al. |
| 2006/0113565 | A1 | 6/2006 | Abe et al. |
| 2006/0169973 | A1 | 8/2006 | Isa et al. |
| 2006/0170111 | A1 | 8/2006 | Isa et al. |
| 2006/0197092 | A1 | 9/2006 | Hoffman et al. |
| 2006/0208977 | A1 | 9/2006 | Kimura |
| 2006/0228974 | A1 | 10/2006 | Thelss et al. |
| 2006/0231882 | A1 | 10/2006 | Kim et al. |
| 2006/0238135 | A1 | 10/2006 | Kimura |
| 2006/0244107 | A1 | 11/2006 | Sugihara et al. |
| 2006/0284171 | A1 | 12/2006 | Levy et al. |
| 2006/0284172 | A1 | 12/2006 | Ishii |
| 2006/0292777 | A1 | 12/2006 | Dunbar |
| 2007/0024187 | A1 | 2/2007 | Shin et al. |
| 2007/0046191 | A1 | 3/2007 | Saito |
| 2007/0052025 | A1 | 3/2007 | Yabuta |
| 2007/0054507 | A1 | 3/2007 | Kaji et al. |
| 2007/0090365 | A1 | 4/2007 | Hayashi et al. |
| 2007/0108446 | A1 | 5/2007 | Akimoto |
| 2007/0152217 | A1 | 7/2007 | Lai et al. |
| 2007/0172591 | A1 | 7/2007 | Seo et al. |
| 2007/0187678 | A1 | 8/2007 | Hirao et al. |
| 2007/0187760 | A1 | 8/2007 | Furuta et al. |
| 2007/0194379 | A1 | 8/2007 | Hosono et al. |
| 2007/0252928 | A1 | 11/2007 | Ito et al. |
| 2007/0272922 | A1 | 11/2007 | Kim et al. |
| 2007/0287296 | A1 | 12/2007 | Chang |
| 2008/0006877 | A1 | 1/2008 | Mardilovich et al. |
| 2008/0038882 | A1 | 2/2008 | Takechi et al. |
| 2008/0038929 | A1 | 2/2008 | Chang |
| 2008/0050595 | A1 | 2/2008 | Nakagawara et al. |
| 2008/0073653 | A1 | 3/2008 | Iwasaki |
| 2008/0083950 | A1 | 4/2008 | Pan et al. |
| 2008/0106191 | A1 | 5/2008 | Kawase |
| 2008/0128689 | A1 | 6/2008 | Lee et al. |
| 2008/0129195 | A1 | 6/2008 | Ishizaki et al. |
| 2008/0166834 | A1 | 7/2008 | Kim et al. |
| 2008/0182358 | A1 | 7/2008 | Cowdery-Corvan et al. |
| 2008/0224133 | A1 | 9/2008 | Park et al. |
| 2008/0254569 | A1 | 10/2008 | Hoffman et al. |
| 2008/0258139 | A1 | 10/2008 | Ito et al. |
| 2008/0258140 | A1 | 10/2008 | Lee et al. |
| 2008/0258141 | A1 | 10/2008 | Park et al. |
| 2008/0258143 | A1 | 10/2008 | Kim et al. |
| 2008/0296568 | A1 | 12/2008 | Ryu et al. |
| 2008/0303769 | A1 | 12/2008 | Tobita |
| 2009/0068773 | A1 | 3/2009 | Lai et al. |
| 2009/0073325 | A1 | 3/2009 | Kuwabara et al. |
| 2009/0114910 | A1 | 5/2009 | Chang |
| 2009/0134399 | A1 | 5/2009 | Sakakura et al. |
| 2009/0152506 | A1 | 6/2009 | Umeda et al. |
| 2009/0152541 | A1 | 6/2009 | Maekawa et al. |
| 2009/0225063 | A1 | 9/2009 | Shigaki et al. |
| 2009/0278122 | A1 | 11/2009 | Hosono et al. |
| 2009/0280600 | A1 | 11/2009 | Hosono et al. |
| 2010/0065844 | A1 | 3/2010 | Tokunaga |
| 2010/0092800 | A1 | 4/2010 | Itagaki et al. |
| 2010/0109002 | A1 | 5/2010 | Itagaki et al. |
| 2010/0195028 | A1 | 8/2010 | Kubota et al. |
| 2010/0245724 | A1 | 9/2010 | Nishi et al. |
| 2011/0031492 | A1* | 2/2011 | Yamazaki et al. ..... 257/43 |
| 2011/0096062 | A1* | 4/2011 | Gondo ..... 345/212 |

FOREIGN PATENT DOCUMENTS

| | | | |
|---|---|---|---|
| EP | 1 737 044 | A1 | 12/2006 |
| EP | 2 226 847 | A2 | 9/2010 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 11-505377 | A | 5/1999 |
| JP | 2000-044236 | A | 2/2000 |
| JP | 2000-150900 | A | 5/2000 |
| JP | 2002-076356 | A | 3/2002 |
| JP | 2002-289859 | A | 10/2002 |
| JP | 2003-086000 | A | 3/2003 |
| JP | 2003-086808 | A | 3/2003 |
| JP | 2004-103957 | A | 4/2004 |
| JP | 2004-273614 | A | 9/2004 |
| JP | 2004-273732 | A | 9/2004 |
| JP | 2006-276541 | A | 10/2006 |
| JP | 2009-015286 | A | 1/2009 |
| JP | 2009-210880 | A | 9/2009 |
| JP | 2010-250306 | A | 11/2010 |
| KR | 2010-0108213 | A | 10/2010 |
| WO | 2004/114391 | A1 | 12/2004 |

OTHER PUBLICATIONS

Asaoka, Y et al., "29.1: Polarizer-Free Reflective LCD Combined With Ultra Low-Power Driving Technology," SID Digest '09 : SID International Symposium Digest of Technical Papers, 2009, pp. 395-398.

Chern, H et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.

Cho, D et al., "21.2: Al and Sn-Doped Zinc Indium Oxide Thin Film Transistors for AMOLED Back-Plane," SID Digest '09 : SID International Symposium Digest of Technical Papers, May 31, 2009, pp. 280-283.

Clark, S et al., "First Principles Methods Using CASTEP," Zeitschrift fur Kristallographie, 2005, vol. 220, pp. 567-570.

Coates. D et al., "Optical Studies of the Amorphous Liquid-Cholesteric Liquid Crystal Transition: The Blue Phase," Physics Letters, Sep. 10, 1973, vol. 45A, No. 2, pp. 115-116.

Costello, M et al., "Electron Microscopy of a Cholesteric Liquid Crystal and Its Blue Phase," Phys. Rev. A (Physical Review. A), May 1, 1984, vol. 29, No. 5, pp. 2957-2959.

(56) References Cited

OTHER PUBLICATIONS

Dembo, H et al., "RFCPUS on Glass and Plastic Substrates Fabricated by TFT Transfer Technology," IEDM 05: Technical Digest of International Electron Devices Meeting, Dec. 5, 2005, pp. 1067-1069.
Fortunato, E et al., "Wide-Bandgap High-Mobility ZnO Thin-Film Transistors Produced at Room Temperature," Appl. Phys. Lett. (Applied Physics Letters), Sep. 27, 2004, vol. 85, No. 13, pp. 2541-2543.
Fung, T et al., "2-D Numerical Simulation of High Performance Amorphous In-Ga-Zn-O TFTs for Flat Panel Displays," AM-FPD '08 Digest of Technical Papers, Jul. 2, 2008, pp. 251-252, The Japan Society of Applied Physics.
Godo, H et al., "P-9: Numerical Analysis on Temperature Dependence of Characteristics of Amorphous In-Ga-Zn-Oxide TFT," SID Digest '09 : SID International Symposium Digest of Technical Papers, May 31, 2009, pp. 1110-1112.
Godo, H et al., "Temperature Dependence of Characteristics and Electronic Structure for Amorphous In-Ga-Zn-Oxide TFT," AM-FPD '09 Digest of Technical Papers, Jul. 1, 2009, pp. 41-44.
Hayashi, R et al., "42.1: Invited Paper: Improved Amorphous In-Ga-Zn-O TFTs," SID Digest '08 : SID International Symposium Digest of Technical Papers, May 20, 2008, vol. 39, pp. 621-624.
Hirao, T et al., "Novel Top-Gate Zinc Oxide Thin-Film Transistors (ZnO TFTs) for AMLCDs," Journal of the SID , 2007, vol. 15, No. 1, pp. 17-22.
Hosono, H et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Hosono, H, "68.3: Invited Paper:Transparent Amorphous Oxide Semiconductors for High Performance TFT," SID Digest '07 : SID International Symposium Digest of Technical Papers, 2007, vol. 38, pp. 1830-1833.
Hsieh, H et al., "P-29: Modeling of Amorphous Oxide Semiconductor Thin Film Transistors and Subgap Density of States," SID Digest '08 : SID International Symposium Digest of Technical Papers, 2008, vol. 39, pp. 1277-1280.
Ikeda, T et al., "Full-Functional System Liquid Crystal Display Using CG-Silicon Technology," SID Digest '04 : SID International Symposium Digest of Technical Papers, 2004, vol. 35, pp. 860-863.
Janotti, A et al., "Native Point Defects in ZnO," Phys. Rev. B (Physical Review. B), 2007, vol. 76, No. 16, pp. 165202-1-165202-22.
Janotti, A et al., "Oxygen Vacancies in ZnO," Appl. Phys. Lett. (Applied Physics Letters), 2005, vol. 87, pp. 122102-1-122102-3.
Jeong, J et al., "3.1: Distinguished Paper: 12.1-Inch WXGA AMOLED Display Driven by Indium-Gallium-Zinc Oxide TFTs Array," SID Digest '08 : SID International Symposium Digest of Technical Papers, May 20, 2008, vol. 39, No. 1, pp. 1-4.
Jin, D et al., "65.2: Distinguished Paper:World-Largest (6.5") Flexible Full Color Top Emission AMOLED Display on Plastic Film and Its Bending Properties," SID Digest '09 : SID International Symposium Digest of Technical Papers, May 31, 2009, pp. 983-985.
Kanno, H et al., "White Stacked Electrophosphorecent Organic Light-Emitting Devices Employing MOO3 as a Charge-Generation Layer," Adv. Mater. (Advanced Materials), 2006, vol. 18, No. 3, pp. 339-342.
Kikuchi, H et al., "39.1: Invited Paper: Optically Isotropic Nano-Structured Liquid Crystal Composites for Display Applications," SID Digest '09 : SID International Symposium Digest of Technical Papers, May 31, 2009, pp. 578-581.
Kikuchi, H et al., "62.2: Invited Paper: Fast Electro-Optical Switching in Polymer-Stabilized Liquid Crystalline Blue Phases for Display Application," SID Digest '07 : SID International Symposium Digest of Technical Papers, 2007, vol. 38, pp. 1737-1740.
Kikuchi, H et al., "Polymer-Stabilized Liquid Crystal Blue Phases," Nature Materials, Sep. 1, 2002, vol. 1, pp. 64-68.
Kim, S et al., "High-Performance oxide thin film transistors passivated by various gas plasmas," The Electrochemical Society, 214th ECS Meeting, 2008, No. 2317, 1 page.
Kimizuka, N et al., "Spinel,YbFe2O4, and Yb2Fe3O7 Types of Structures for Compounds in the In2O3 and Sc2O3-A2O3-BO Systems [A; Fe, Ga, or Al; B: Mg, Mn, Fe, Ni, Cu,or Zn] at Temperatures Over 1000° C," Journal of Solid State Chemistry, 1985, vol. 60, pp. 382-384.
Kimizuka, N et al., "Syntheses and Single-Crystal Data of Homologous Compounds, In2O3(ZnO)m (m = 3, 4, and 5), InGaO3(ZnO)3, and Ga2O3(ZnO)m (m = 7, 8, 9, and 16) in the In2O3-ZnGa2O4-ZnO System," Journal of Solid State Chemistry, Apr. 1, 1995, vol. 116, No. 1, pp. 170-178.
Kitzerow, H et al., "Observation of Blue Phases in Chiral Networks," Liquid Crystals, 1993, vol. 14, No. 3, pp. 911-916.
Kurokawa, Y et al., "UHF RFCPUS on Flexible and Glass Substrates for Secure RFID Systems," Journal of Solid-State Circuits , 2008, vol. 43, No. 1, pp. 292-299.
Lany, S et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Lee, H et al., "Current Status of, Challenges to, and Perspective View of AM-OLED," IDW '06 : Proceedings of the 13th International Display Workshops, Dec. 7, 2006, pp. 663-666.
Lee, J et al., "World's Largest (15-Inch) XGA AMLCD Panel Using IGZO Oxide TFT," SID Digest '08 : SID International Symposium Digest of Technical Papers, May 20, 2008, vol. 39, pp. 625-628.
Lee, M et al., "15.4: Excellent Performance of Indium-Oxide-Based Thin-Film Transistors by DC Sputtering," SID Digest '09 : SID International Symposium Digest of Technical Papers, May 31, 2009, pp. 191-193.
Li, C et al "Modulated Structures of Homologous Compounds InMO3(ZnO)m (M=in,Ga; m=Integer) Described by Four-Dimensional Superspace Group," Journal of Solid State Chemistry, 1998, vol. 139, pp. 347-355.
Masuda, S et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Meiboom, S et al., "Theory of the Blue Phase of Cholesteric Liquid Crystals," Phys. Rev. Lett. (Physical Review Letters), May 4, 1981, vol. 46, No. 18, pp. 1216-1219.
Miyasaka, M, "SUFTLA Flexible Microelectronics on Their Way to Business," SID Digest '07 : SID International Symposium Digest of Technical Papers, 2007, vol. 38, pp. 1673-1676.
Mo, Y et al., "Amorphous Oxide TFT Backplanes for Large Size AMOLED Displays," IDW'08 : Proceedings of the 6th International Display Workshops, Dec. 3, 2008, pp. 581-584.
Nakamura, "Synthesis of Homologous Compound with New Long-Period Structure," NIRIM Newsletter, Mar. 1995, vol. 150, pp. 1-4 with English translation.
Nakamura, M et al., "The phase relations in the In2O3-Ga2ZnO4-ZnO system at 1350° C," Journal of Solid State Chemistry, Aug. 1, 1991, vol. 93, No. 2, pp. 298-315.
Nomura, K et al., "Thin-Film Transistor Fabricated in Single-Crystalline Transparent Oxide Semiconductor," Science, May 23, 2003, vol. 300, No. 5623, pp. 1269-1272.
Nomura, K et al., "Amorphous Oxide Semiconductors for High-Performance Flexible Thin-Film Transistors," Jpn. J. Appl. Phys. (Japanese Journal of Applied Physics) , 2006, vol. 45, No. 5B, pp. 4303-4308.
Nomura, K et al., "Room-Temperature Fabrication of Transparent Flexible Thin-Film Transistors Using Amorphous Oxide Semiconductors," Nature, Nov. 25, 2004, vol. 432, pp. 488-492.
Nomura, K et al., "Carrier transport in transparent oxide semiconductor with intrinsic structural randomness probed using single-crystalline InGaO3(ZnO)5 films," Appl. Phys. Lett. (Applied Physics Letters) , Sep. 13, 2004, vol. 85, No. 11, pp. 1993-1995.
Nowatari, H et al., "60.2: Intermediate Connector With Suppressed Voltage Loss for White Tandem OLEDS," SID Digest '09 : SID International Symposium Digest of Technical Papers, May 31, 2009, vol. 40, pp. 899-902.
Oba, F et al., "Defect energetics in ZnO: A hybrid Hartree-Fock density functional study," Phys. Rev. B (Physical Review. B), 2008, vol. 77, pp. 245202-1-245202-6.

(56) References Cited

OTHER PUBLICATIONS

Oh, M et al., "Improving the Gate Stability of ZnO Thin-Film Transistors With Aluminum Oxide Dielectric Layers," J. Electrochem. Soc. (Journal of the Electrochemical Society), 2008, vol. 155, No. 12, pp. H1009-H1014.
Ohara, H et al., "21.3: 4.0 in. QVGA AMOLED Display Using In-Ga-Zn-Oxide TFTs With a Novel Passivation Layer," SID Digest '09 : SID International Symposium Digest of Technical Papers, May 31, 2009, pp. 284-287.
International Search Report (PCT Patent Application No. PCT/JP2012/078412) dated Jan. 29, 2013.
Written Opinion (PCT Patent Application No. PCT/JP2012/078412) dated Jan. 29, 2013.
Ohara, H et al., "Amorphous In-Ga-Zn-Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Orita, M et al., "Amorphous transparent conductive oxide InGaO3(ZnO)m (m<4):a Zn4s conductor," Philosophical Magazine, 2001, vol. 81, No. 5, pp. 501-515.
Orita, M et al., "Mechanism of Electrical Conductivity of Transparent InGaZnO4," Phys. Rev. B (Physical Review. B), Jan. 15, 2000, vol. 61, No. 3, pp. 1811-1816.
Osada, T et al., "15.2: Development of Driver-Integrated Panel using Amorphous In-Ga-Zn-Oxide TFT," SID Digest '09 : SID International Symposium Digest of Technical Papers, May 31, 2009, pp. 184-187.
Osada, T et al., "Development of Driver-Integrated Panel Using Amorphous In-Ga-Zn-Oxide TFT," AM-FPD '09 Digest of Technical Papers, Jul. 1, 2009, pp. 33-36.
Park, J et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Park, J et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Park, J et al., "Electronic Transport Properties of Amorphous Indium-Gallium-Zinc Oxide Semiconductor Upon Exposure to Water," Appl. Phys. Lett. (Applied Physics Letters), 2008, vol. 92, pp. 072104-1-072104-3.
Park, J et al., "High performance amorphous oxide thin film transistors with self-aligned top-gate structure," IEDM 09: Technical Digest of International Electron Devices Meeting, Dec. 7, 2009, pp. 191-194.
Park, Sang-Hee et al., "42.3: Transparent ZnO Thin Film Transistor for the Application of High Aperture Ratio Bottom Emission AM-OLED Display," SID Digest '08 : SID International Symposium Digest of Technical Papers, May 20, 2008, vol. 39, pp. 629-632.
Park, J et al., "Amorphous Indium-Gallium-Zinc Oxide TFTs and Their Application for Large Size AMOLED" AM-FPD '08 Digest of Technical Papers, Jul. 2, 2008, pp. 275-278.
Park, S et al., "Challenge to Future Displays: Transparent AM-OLED Driven by PEALD Grown ZnO TFT," IMID '07 Digest, 2007, pp. 1249-1252.
Prins, M et al., "A Ferroelectric Transparent Thin-Film Transistor," Appl. Phys. Lett. (Applied Physics Letters), Jun. 17, 1996, vol. 68, No. 25, pp. 3650-3652.
Sakata, J et al., "Development of 4.0-In. AMOLED Display With Driver Circuit Using Amorphous In-Ga-Zn-Oxide TFTs," IDW '09 : Proceedings of the 16th International Display Workshops, 2009, pp. 689-692.
Son, K et al., "42.4L: Late-News Paper: 4 Inch QVGA AMOLED Driven by the Threshold Voltage Controlled Amorphous GIZO (Ga2O3-In2O3-ZnO) TFT," SID Digest '08 : SID International Symposium Digest of Technical Papers, May 20, 2008, vol. 39, pp. 633-636.
Takahashi, M et al., "Theoretical Analysis of IGZO Transparent Amorphous Oxide Semiconductor," IDW '08 : Proceedings of the 15TH International Display Workshops, Dec. 3, 2008, pp. 1637-1640.
Tsuda, K et al., "Ultra Low Power Consumption Technologies for Mobile TFT-LCDs," IDW '02 : Proceedings of the 9th International Display Workshops, Dec. 4, 2002, pp. 295-298.
Ueno, K et al., "Field-Effect Transistor on SrTiO3 With Sputtered Al2O3 Gate Insulator," Appl. Phys. Lett. (Applied Physics Letters), Sep. 1, 2003, vol. 83, No. 9, pp. 1755-1757.
Van De Walle, C, "Hydrogen as a Cause of Doping in Zinc Oxide," Phys. Rev. Lett. (Physical Review Letters), Jul. 31, 2000, vol. 85, No. 5, pp. 1012-1015.

* cited by examiner

SIGNAL LINE DRIVER CIRCUIT AND LIQUID CRYSTAL DISPLAY DEVICE

TECHNICAL FIELD

One embodiment of the present invention relates to a signal line driver circuit. One embodiment of the present invention relates to a liquid crystal display device.

BACKGROUND ART

In recent years, semiconductor devices such as liquid crystal display devices have been developed.

One of known liquid crystal display devices is a liquid crystal display device employing a driving method in which a plurality of pixel circuits are provided in rows and columns and in which the polarity of the potential of one of a pair of electrodes in each liquid crystal element and the polarity of the potential of the other electrode are inverted evey frame period on a row-by-row basis (e.g., Patent Document 1).

Employing the driving method can reduce driving voltage of a signal line driver circuit provided in a liquid crystal display device while preventing burn-in of a display image due to liquid crystal elements.

For example, Patent Document 1 discloses a technique in which the potentials of a plurality of common signal lines are controlled with a signal line driver circuit such as a common signal line driver circuit so that the potential of the other of the pair of electrodes of each liquid crystal element is inverted every frame period.

The signal line driver circuit shown in Patent Document 1 is provided with a shift register and a plurality of circuits including a latch unit and a buffer unit. In the signal line driver circuit shown in Patent Document 1, the buffer unit outputs, as a common signal, a signal the potential of which is controlled in accordance with data stored in the latch unit.

REFERENCE

[Patent Document 1] Japanese Published Patent Application No. 2006-276541

DISCLOSURE OF INVENTION

However, a conventional signal line driver circuit has a problem of easily causing a malfunction.

For example, in the signal line driver circuit shown in Patent Document 1, there is a problem in that leakage current of a field-effect transistor included in the signal line driver circuit changes the potential that is the data stored in the latch unit, so that the potential of an output signal does not have a desired value, whereby a desired operation cannot be performed.

In view of the above problem, an object of one embodiment of the present invention is to prevent a malfunction from occurring.

In one embodiment of the present invention, a signal having a function as a driving signal is generated by a circuit that includes a latch unit, a buffer unit, and a switch unit for controlling rewriting of data stored in the latch unit, whereby a change in the data stored in the latch unit is suppressed.

The switch unit has a function of controlling rewriting of data stored in the latch unit in accordance with a first control signal and a second control signal. Thus, data is rewritten in a period during which pulses of a set signal and a reset signal are not input, whereby a change in the potential that is the data stored in the latch unit is suppressed.

One embodiment of the present invention is the signal line driver circuit that includes a shift register, a selection circuit, and a driving signal output circuit. The selection circuit has a function of determining which a first pulse signal or a second pulse signal is output at the same potential level as a pulse signal input from the shift register, in accordance with a first clock signal and a second clock signal. The driving signal output circuit has functions of generating and outputting a driving signal for controlling a potential of a signal line in accordance with the first and second pulse signals input from the selection circuit and first and second control signals. The driving signal output circuit includes a latch unit configured to rewrite and store first data and second data in accordance with the first and second pulse signals, a buffer unit configured to set a potential of the driving signal in accordance with the first data and the second data and output the driving signal, and a switch unit configured to control rewriting of the first data by being turned on or off in accordance with the first control signal and the second control signal.

One embodiment of the present invention is the signal line driver circuit that includes a shift register, a selection circuit, and a driving signal output circuit. The selection circuit has a function of determining which a first pulse signal or a second pulse signal is output at the same potential level as a pulse signal input from the shift register, in accordance with a first clock signal and a second clock signal. The driving signal output circuit has functions of generating and outputting a driving signal for controlling a potential of a signal line in accordance with the first and second pulse signals input from the selection circuit and first to fifth control signals. The driving signal output circuit includes a first latch unit configured to rewrite and store first data and second data in accordance with the first and second pulse signals, a second latch unit configured to rewrite and store third data and fourth data in accordance with the first and second pulse signals, a first buffer unit configured to set a potential of the first signal in accordance with the first data and the second data and output the first signal, a second buffer unit configured to set a potential of the second signal in accordance with the third data and the fourth data and output the second signal, a first switch unit configured to control rewriting of the first data by being turned on or off in accordance with the first control signal and the second control signal, a second switch unit configured to control rewriting of the third data by being turned on or off in accordance with the first control signal and the third control signal, a third switch unit to which the second signal is input as the fourth control signal and that is configured to control rewriting of the second data stored in the first latch unit by being turned on or off in accordance with the fourth control signal, a fourth switch unit to which the first signal is input as the fifth control signal and that is configured to control rewriting of the fourth data stored in the second latch unit by being turned on or off in accordance with the fifth control signal, and a third buffer unit configured to set a potential of the driving signal in accordance with the first signal and the second signal and output the driving signal.

In one embodiment of the present invention, the potential of the other of a pair of electrodes in each liquid crystal element of pixel circuits is controlled by using the signal line driver circuit. Accordingly, a plurality of pixel circuits are provided in rows and columns and which the polarity of the potential of one of a pair of electrodes in each liquid crystal element and the polarity of the potential of the other electrode are inverted evey frame period on a row-by-row basis; accordingly, the voltage of a gate signal is reduced.

In one embodiment of the present invention, the liquid crystal element includes liquid crystal which exhibits a blue phase. Thus, a liquid crystal display device that operates at higher speed can be provided.

In one embodiment of the present invention, a change in the potential that is the data stored in a latch unit and a change in the potential of a signal output from a signal line driver circuit can be suppressed; therefore, a malfunction can be prevented from occurring.

BEST MODE FOR CARRYING OUT THE INVENTION

Examples of embodiments of the present invention will be described. Note that it will be readily appreciated by those skilled in the art that details of the embodiments can be modified in various ways without departing from the spirit and scope of the invention. The present invention is therefore not limited to the following description of the embodiments, for example.

Note that the contents in different embodiments can be combined with one another as appropriate. In addition, the contents of the embodiments can be replaced with each other as appropriate.

Further, the ordinal numbers such as "first" and "second" are used to avoid confusion between components and do not limit the number of each component.

Embodiment 1

In this embodiment, an example of a signal line driver circuit that has a function of outputting a plurality of driving signals will be described with reference to FIG. 1, FIG. 2, FIGS. 3A and 3B, FIG. 4, FIGS. 5A and 5B, and FIG. 6.

Figure 1:
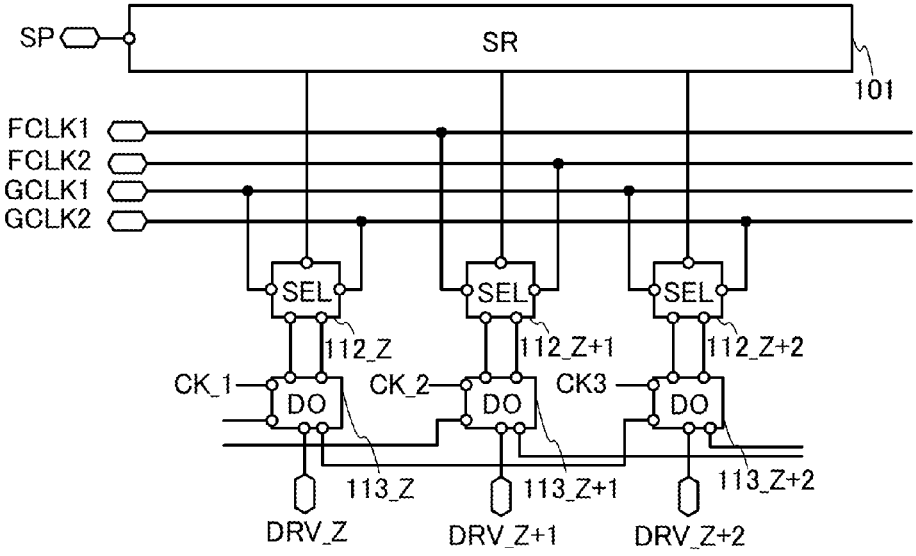
FIG. 1 illustrates an example of a signal line driver circuit.

As illustrated in FIG. 1, the signal line driver circuit of this embodiment includes a shift register (also referred to as SR) 101, a plurality of selection circuits (also referred to as SEL) 112 (in FIG. 1, the selection circuits 112_Z (Z is a natural number), 112_Z+1, and 112_Z+2), and a plurality of driving signal output circuits (also referred to as DO) 113 (in FIG. 1, the driving signal output circuits 113_Z, 113_Z+1, and 113_Z+2). For example, each signal line is provided with the selection circuit 112 and the driving signal output circuit 113. A pulse signal generated by the driving signal output circuit 113 is output through a corresponding signal line.

A start pulse signal SP is input to the shift register 101.

The shift register 101 has a function of outputting a plurality of pulse signals (also referred to as SROUT), the potentials of which are controlled, in accordance with the start pulse signal SP.

Figure 2:
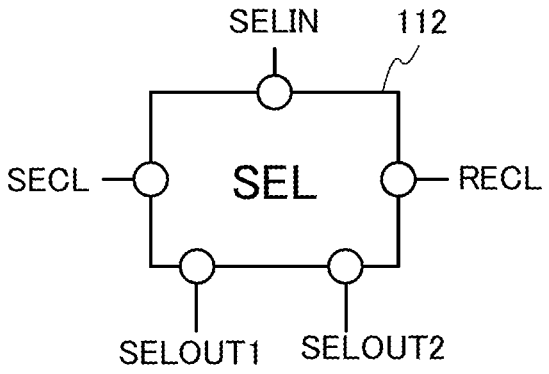
FIG. 2 illustrates an example of a selection circuit.

As illustrated in FIG. 2, a pulse signal is input as a pulse signal SELIN from the shift register 101 to the selection circuit 112. Further, a clock signal SECL and a clock signal RECL are input to the selection circuit 112. For example, different pulse signals are input to the plurality of selection circuits 112. The selection circuit 112 outputs a pulse signal SELOUT1 and a pulse signal SELOUT2, as illustrated in FIG. 2.

The selection circuit 112 has a function of determining which the pulse signal SELOUT1 or the pulse signal SELOUT2 is output at the same potential level as the pulse signal SELIN, depending on the pulse signal SELIN, the clock signal SECL, and the clock signal RECL For example, the selection circuit 112 includes a plurality of field-effect transistors. In this case, switching of the plurality of field-effect transistors can determine which the pulse signal SELOUT1 or the pulse signal SELOUT2 is output at the same potential level as the pulse signal SELIN.

To the selection circuits 112_Z and 112_Z+2 illustrated in FIG. 1, a clock signal GCLK1 and a clock signal GCLK2 are input as the clock signal SECL and the clock signal RECL, respectively. To the selection circuit 112_Z+1, a clock signal FCLK1 and a clock signal FCLK2 are input as the clock signal SECL and the clock signal RECL, respectively.

Figure 3A:
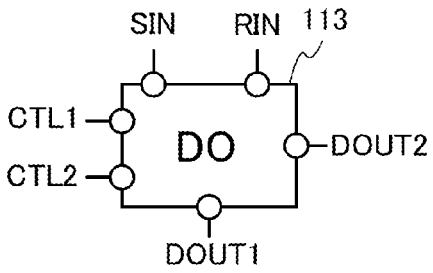
FIGS. 3A and 3B illustrate an example of a driving signal output circuit.

As illustrated in FIG. 3A, a set signal SN, a reset signal RN, a control signal CTL1, and a control signal CTL2 are input to the driving signal output circuit 113. The driving signal output circuit 113 outputs a signal DOUT1 and a signal DOUT2 as illustrated in FIG. 3A. The signal DOUT1 serves as a driving signal. The driving signal output circuit 113 has a function of generating and outputting a driving signal in accordance with the set signal SN, the reset signal RIN, the control signal CTL1, and the control signal CTL2. For example, the driving signal is output to a wiring for controlling the potential of a signal line.

For example, the driving signal output circuit 113 includes a plurality of field-effect transistors.

Figure 3B:
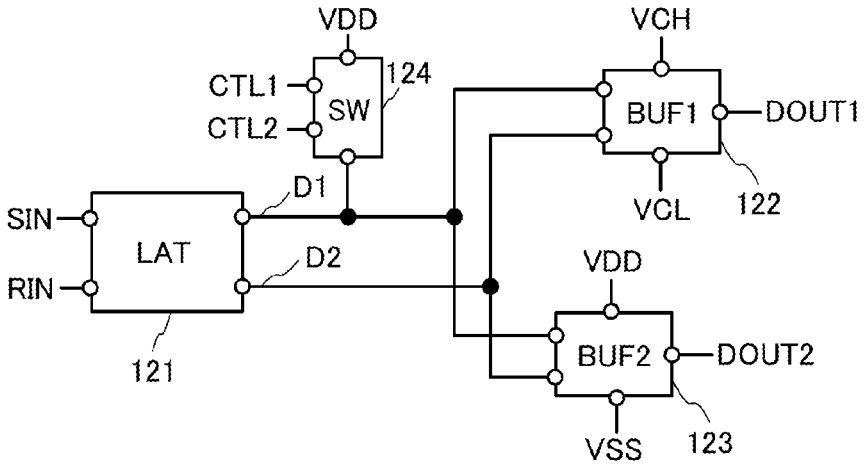

Further, as illustrated in FIG. 3B, the driving signal output circuit 113 includes a latch unit (also referred to as LAT) 121, a first buffer unit (also referred to as BUF1) 122, a second buffer unit (also referred to as BUF2) 123, and a switch unit (also referred to as SW) 124.

The set signal SN and the reset signal RN are input to the latch unit 121.

The latch unit 121 has a function of rewriting and storing data D1 and data D2 in accordance with the set signal SN and the reset signal RN.

The first buffer unit 122 has functions of setting the potential of the signal DOUT1 in accordance with the data D1 and the data D2 stored in the latch unit 121 and outputting the signal DOUT1. The potential of the signal DOUT1 changes in the range from a potential VCH to a potential VCL (a potential which is lower than the potential VCH).

The second buffer unit 123 has functions of setting the potential of the signal DOUT2 in accordance with the data D1 and the data D2 stored in the latch unit 121 and outputting the signal DOUT2. The potential of the signal DOUT2 changes in the range from a potential VDD to a potential VSS. The potential VDD is higher than the potential VSS and is the potential of a high-level signal (also referred to as a potential VH). The potential VSS is lower than or equal to a ground potential and is the potential of a low-level signal (also referred to as a potential VL).

The control signal CTL1 and the control signal CTL2 are input to the switch unit 124.

The switch unit 124 has a function of controlling rewriting of the data D1 stored in the latch unit 121 by being turned on or off in accordance with the control signal CTL1 and the control signal CTL2.

As the control signal CTL1, a signal with a period during which an interval between successive pulses is shorter than that of a start pulse signal can be used.

To the driving signal output circuit 113, the pulse signal SELOUT1 is input from the selection circuit 112 as the set signal SN, and the pulse signal SELOUT2 is input from the selection circuit 112 as the reset signal RN. In this case, the latch unit 121 has a function of rewriting and storing the data D1 and the data D2 in accordance with the pulse signal SELOUT1 and the pulse signal SELOUT2.

A clock signal CK_1 is input as the control signal CTL1 of the driving signal output circuit 113_Z illustrated in FIG. 1. A clock signal CK_2 is input as the control signal CTL1 of the driving signal output circuit 113_Z+1. A clock signal CK_3 is input as the control signal CTL1 of the driving signal output circuit 113_Z+2.

The signal DOUT1 of the driving signal output circuit 113_Z illustrated in FIG. 1 serves as a driving signal DRV_Z. The signal DOUT1 of the driving signal output circuit 113_Z+1 serves as a driving signal DRV_Z+1. The signal DOUT1 of the driving signal output circuit 113_Z+2 serves as a driving signal DRV_Z+2.

As the control signal CTL2 of the driving signal output circuit 113_Z+2 illustrated in FIG. 1, the signal DOUT2 of the driving signal output circuit 113_Z is input. In this case, in comparison with the case of inputting the clock signal GCLK1, a period in which the data D1 can be rewritten can be longer; therefore, a malfunction of a signal line driver circuit can be more effectively suppressed.

Figure 4:
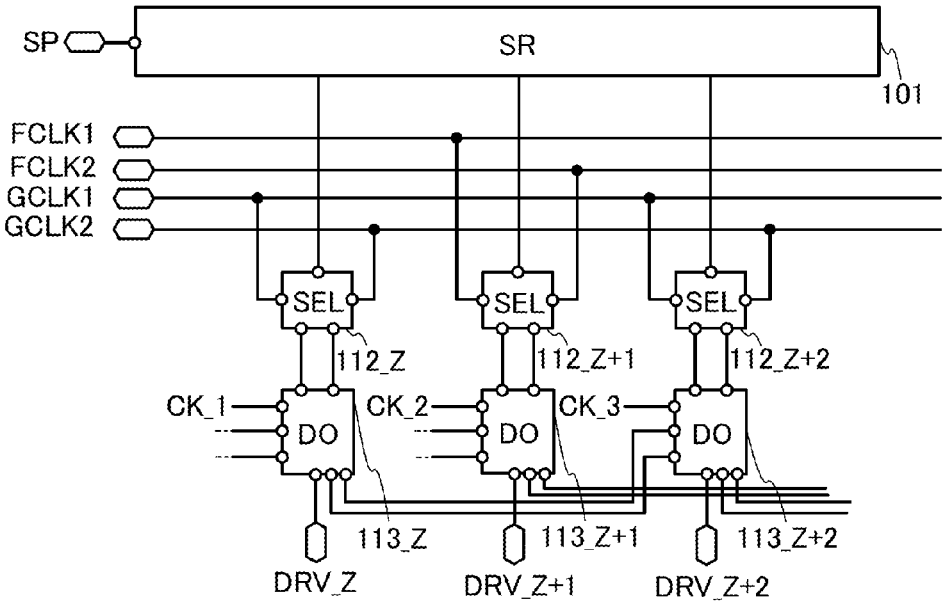
FIG. 4 illustrates an example of a signal line driver circuit.

Connection relations of the plurality of driving signal output circuits 113 provided in the signal line driver circuit illustrated in FIG. 1 may be those shown in FIG. 4.

Figure 5A:
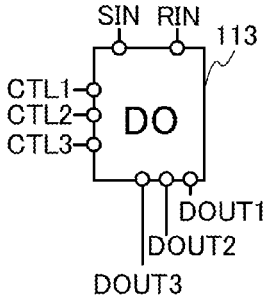
FIGS. 5A and 5B illustrate an example of a driving signal output circuit.

In the configuration in FIG. 4, as illustrated in FIG. 5A, a set signal SN, a reset signal RN, a control signal CTL1, a control signal CTL2, and a control signal CTL3 are input to a driving signal output circuit 113. The driving signal output circuit 113 outputs a signal DOUT1, a signal DOUT2, and a signal DOUT3 as illustrated in FIG. 5A. The driving signal output circuit 113 has a function of generating and outputting a driving signal in accordance with the set signal SN, the reset signal RIN, and control signals CTL1 to CTL5.

Figure 5B:
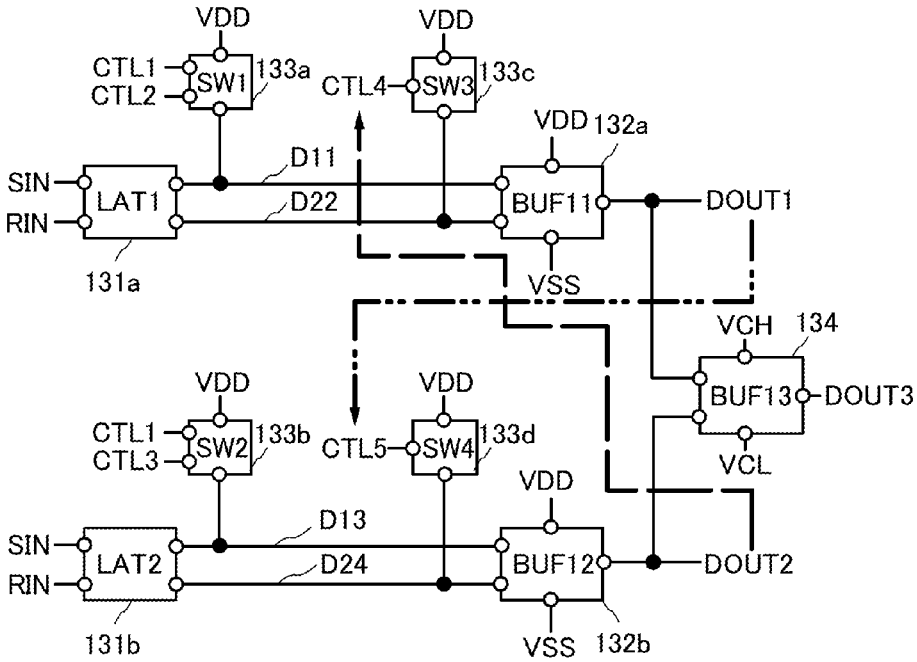

The driving signal output circuit 113 includes, as illustrated in FIG. 5B, a first latch unit (also referred to as LAT1) 131*a*, a second latch unit (also referred to as LAT2) 131*b*, a first buffer unit (also referred to as BUF11) 132*a*, a second buffer unit (also referred to as BUF12) 132*b*, a first switch unit (also referred to as SW1) 133*a*, a second switch unit (also referred to as SW2) 133*b*, a third switch unit (also referred to as SW3) 133*c*, a fourth switch unit (also referred to as SW4) 133*d*, and a third buffer unit (also referred to as BUF13) 134.

The set signal SN and the reset signal RN are input to the first latch unit 131*a*.

The first latch unit 131*a* has a function of rewriting and storing data D11 and data D22 in accordance with the set signal SN and the reset signal RN.

The set signal SN and the reset signal RN are input to the second latch unit 131*b*.

The second latch unit 131*b* has a function of rewriting and storing data D13 and data D24 in accordance with the set signal SN and the reset signal RN.

The first buffer unit 132*a* has a function of setting the potential of the signal DOUT1 in accordance with the data D11 and the data D22 stored in the first latch unit 131*a* and outputting the signal DOUT1. The potential of the signal DOUT1 changes in the range from a potential VDD (VH) to a potential VSS (VL).

The second buffer unit 132*b* has a function of setting the potential of the signal DOUT2 in accordance with the data D13 and the data D24 stored in the second latch unit 131*b* and outputting the signal DOUT2. The potential of the signal DOUT2 changes in the range from the potential VDD (VH) to the potential VSS (VL).

The control signal CTL1 and the control signal CTL2 are input to the first switch unit 133*a*. The first switch unit 133*a* has a function of controlling rewriting of the data D11 stored in the first latch unit 131*a* by being turned on or off in accordance with the control signal CTL1 and the control signal CTL2.

The control signal CTL1 and the control signal CTL3 are input to the second switch unit 133*b*. The second switch unit 133*b* has a function of controlling rewriting of the data D13 stored in the second latch unit 131*b* by being turned on or off in accordance with the control signal CTL1 and the control signal CTL3.

The signal DOUT2 is input to the third switch unit 133*c* as the control signal CTL4. The third switch unit 133*c* has a function of controlling rewriting of the data D22 stored in the first latch unit 131*a* by being turned on or off in accordance with the control signal CTL4.

The signal DOUT1 is input to the fourth switch unit 133*d* as the control signal CTL5. The fourth switch unit 133*d* has a function of controlling rewriting of the data D24 stored in the second latch unit 131*b* by being turned on or off in accordance with the control signal CTL5.

The signal DOUT2 and the signal DOUT1 are input as the control signal CTL4 of the third switch unit 133*c* and the control signal CTL5 of the fourth switch unit 133*d*, respectively, so that the potential VDD or the potential VSS can keep being supplied as the potential of the data D22 of the first latch unit and the potential of the data D24 of the second latch unit; accordingly, the potential of the data D22 of the first latch unit and the potential of the data D24 of the second latch unit can be kept.

The third buffer unit 134 has a function of setting the potential of the signal DOUT3 in accordance with the signal DOUT1 and the signal DOUT2 and outputting the signal DOUT3. The signal DOUT3 is a driving signal whose potential changes in the range from a potential VCH to a potential VCL.

To each of the plurality of driving signal output circuits 113 illustrated in FIG. 4, one of the pulse signals SELOUT1 of the plurality of selection circuits 112 is input as the set signal SN, and one of the pulse signals SELOUT2 of the plurality of selection circuits 112 is input as the reset signal RIN. For example, to the driving signal output circuit 113_Z+1, the pulse signal SELOUT1 of the selection circuit 112_Z+1 is input as the set signal SN, and the pulse signal SELOUT2 of the selection circuit 112_Z+1 is input as the reset signal RN.

A clock signal CK_1 is input as the control signal CTL1 of the driving signal output circuit 113_Z illustrated in FIG. 4. A clock signal CK_2 is input as the control signal CTL1 of the driving signal output circuit 113_Z+1. A clock signal CK_3 is input as the control signal CTL1 of the driving signal output circuit 113_Z+2.

As the control signal CTL2 of the driving signal output circuit 113_Z+2 illustrated in FIG. 4, the signal DOUT1 of the driving signal output circuit 113_Z is input. As the control signal CTL3 of the driving signal output circuit 113_Z+2 illustrated in FIG. 4, the signal DOUT2 of the driving signal output circuit 113_Z is input. In this case, in comparison with the case where the clock signal GCLK1 is input as the control signal CTL2 of the driving signal output circuit 113_Z+2 and the clock signal GCLK2 is input as the control signal CTL3 of the driving signal output circuit 113_Z+2, a period in which the data D11 and the data D13 illustrated in FIG. 5B can be rewritten can be longer; therefore, a malfunction of a signal line driver circuit can be more effectively suppressed.

The signal DOUT3 of the driving signal output circuit 113_Z illustrated in FIG. 4 serves as a driving signal DRV_Z. The signal DOUT3 of the driving signal output circuit 113_Z+1 serves as a driving signal DRV_Z+1. The signal DOUT3 of the driving signal output circuit 113_Z+2 serves as a driving signal DRV_Z+2.

Note that the shift register 101, the selection circuits 112, and the driving signal output circuits 113 may be formed using field-effect transistors having the same polarity, which simplifies a manufacturing process in comparison with the case where a signal line driver circuit is formed using field-effect transistors having different polarities.

Next, as an example of a method for driving the signal line driver circuit of this embodiment, an example of a method for driving the signal line driver circuit illustrated in FIG. 1 will be described with reference to a timing chart of FIG. 6. Note that as an example, the duty ratio of each of the clock signals CK_1 to CK_3 is 25%, and the clock signals CK_1 to CK_3 are sequentially delayed by a quarter of one cycle period. The duty ratio of each of the clock signals FCLK1, FCLK2, GCLK1, and GCLK2 is 50%. The clock signal FCLK2 is an inverted signal of the clock signal FCLK1, and the clock signal GCLK2 is an inverted signal of the clock signal GCLK1. A double wave line in the timing chart means abbreviation.

Figure 6:
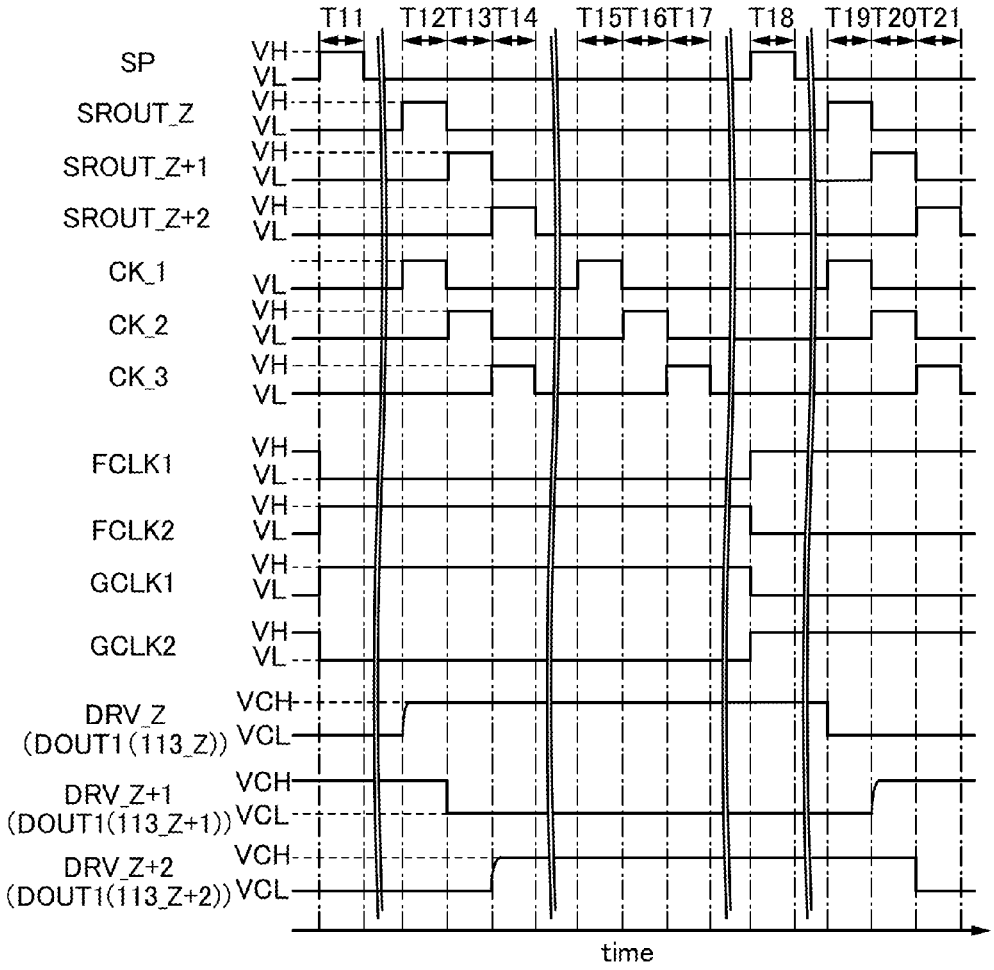
FIG. 6 is a timing chart for illustrating an example of a method for driving a signal line driver circuit.

As shown in FIG. 6, in the example of the method for driving the signal line driver circuit illustrated in FIG. 1, a pulse of the start pulse signal SP is input to the shift register 101 in a period T11.

In this case, in accordance with the clock signals CK_1 to CK_3, a pulse of a pulse signal SROUT_Z is input to the selection circuit 112_Z in a period T12, a pulse of a pulse signal SROUT_Z+1 is input to the selection circuit 112_Z+1 in a period T13, and a pulse of a pulse signal SROUT_Z+2 is input to the selection circuit 112_Z+2 in a period T14. Note that in the periods T11 to T17, the clock signal FCLK1 is at a low level, the clock signal FCLK2 is at a high level, the clock signal GCLK1 is at a high level, and the clock signal GCLK2 is at a low level.

In this case, the selection circuits 112_Z and 112_Z+2 each output the input pulse of the pulse signal SROUT_Z or the pulse signal SROUT_Z+2 as a pulse of the pulse signal SELOUT1.

The selection circuit 112_Z+1 outputs an input pulse of the pulse signal SROUT_Z+1 as a pulse of the pulse signal SELOUT2.

The pulses of the pulse signals SELOUT1 are input to the driving signal output circuit 113_Z and the driving signal output circuit 113_Z+2 as pulses of the set signals SIN. In the driving signal output circuit 113 to which the pulse of the set signal SIN is input, the potential VDD and the potential VSS are written as the data D1 and the data D2, respectively. Accordingly, the potential of the signal DOUT1 becomes the potential VCH and the potential of the signal DOUT2 becomes the potential VH. For example, the signal DOUT1 of the driving signal output circuit 113_Z (driving signal DRV_Z) becomes the potential VCH in the period T12, and the signal DOUT1 of the driving signal output circuit 113_Z+2 (driving signal DRV_Z+2) becomes the potential VCH in the period T14.

The pulse of the pulse signal SELOUT2 is input to the driving signal output circuit 113_Z+1 as a pulse of the reset signal RIN. In the driving signal output circuit 113 to which the pulse of the reset signal RIN is input, the potential VSS and the potential VDD are written as the data D1 and the data D2, respectively. Accordingly, the potential of the signal DOUT1 becomes the potential VCL and the potential of the signal DOUT2 becomes the potential VL. For example, the signal DOUT1 of the driving signal output circuit 113_Z+1 (driving signal DRV_Z+1) becomes the potential VCL in the period T13.

In the periods T15 to T17, the control signal CTL1 and the control signal CTL2 that are input to the driving signal output circuit 113 to which the pulse of the set signal SIN is input become high level in accordance with the clock signals CK_1 to CK_3, the clock signals FCLK1 and FCLK2, and the clock signals GCLK1 and GCLK2. Thus, the potential VDD is written to the driving signal output circuit 113 to which the potential VDD has been written as the data D1, which is data rewriting. Accordingly, a change in the potential of the data D1 can be small until a pulse of the start pulse signal SP is input to the shift register 101 again.

Further, a pulse of the start pulse signal SP is input to the shift register 101 again in a period T18.

In this case, in accordance with the clock signals CK_1 to CK_3, a pulse of the pulse signal SROUT_Z is input to the selection circuit 112_Z in a period T19, a pulse of the pulse signal SROUT_Z+1 is input to the selection circuit 112_Z+1 in a period T20, and a pulse of the pulse signal SROUT_Z+2 is input to the selection circuit 112_Z+2 in a period T21. In the periods T18 to T21, the clock signal FCLK1 is at a high level, the clock signal FCLK2 is at a low level, the clock signal GCLK1 is at a low level, and the clock signal GCLK2 is at a high level.

In this case, the selection circuits 112_Z and 112_Z+2 each output the input pulse of the pulse signal SROUT_Z or the pulse signal SROUT_Z+2 as a pulse of the pulse signal SELOUT2.

The selection circuit 112_Z+1 outputs the input pulse of the pulse signal SROUT_Z+1 as a pulse of the pulse signal SELOUT1.

In the driving signal output circuit 113 to which the pulse of the set signal SIN is input, the potential VDD and the potential VSS are written as the data D1 and the data D2, respectively. Accordingly, the potential of the signal DOUT1 becomes the potential VCH and the potential of the signal DOUT2 becomes the potential VH.

In the driving signal output circuit 113 to which the pulse of the reset signal RIN is input, the potential VSS and the potential VDD are written as the data D1 and the data D2, respectively. The potential of the signal DOUT1 becomes the potential VCL and the potential of the signal DOUT2 becomes the potential VL.

Note that the clock signal FCLK1 and the clock signal GCLK1 may be the same signal, and the clock signal FCLK2 and the clock signal GCLK2 may also be the same signal. In this case, the signal DRV_Z+1 corresponds to a shifted Z-th signal DRV_Z.

The above is the description of an example of the method for driving the signal line driver circuit illustrated in FIG. 1.

As described with reference to FIG. 1, FIG. 2, FIGS. 3A and 3B, FIG. 4, FIGS. 5A and 5B, and FIG. 6, one example of the signal line driver circuit of this embodiment includes a shift register, a plurality of selection circuits to which different pulse signals are input from the shift register and each of which determines which a first pulse signal or a second pulse signal is output at the same potential level as the pulse signal, and driving signal output circuits to which the first pulse signals and the second pulse signals of the different selection circuits are input. With this structure, a plurality of driving signals can be output.

In a driving signal output circuit of one example of the signal line driver circuit of this embodiment, by providing a switch unit for controlling rewriting of data stored in a latch unit, the data can be rewritten even in a period during which a pulse of a pulse signal is not output from the shift register. Accordingly, for example, a change in the potential that is a first data, due to leakage current of a field-effect transistor in the driving signal output circuit can be prevented. Therefore, a malfunction of the signal line driver circuit can be suppressed.

For example, the signal line driver circuit of this embodiment can be applied to a semiconductor device for controlling driving of a plurality of circuits with the use of a plurality of signal lines, such as a liquid crystal display device or electronic paper.

Embodiment 2

In this embodiment, a signal line driver circuit that outputs a driving signal through a common signal line and an example of a liquid crystal display device provided with the signal line driver circuit will be described.

First, a configuration example of a liquid crystal display device will be described with reference to FIG. 7A.

Figure 7A:
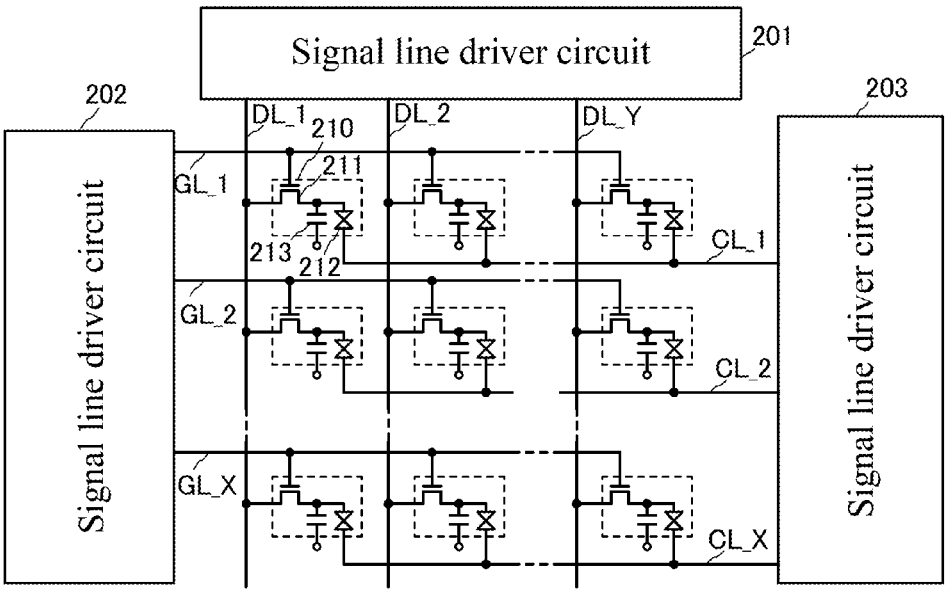
FIGS. 7A and 7B illustrate an example of a liquid crystal display device.

A liquid crystal display device illustrated in FIG. 7A includes a signal line driver circuit 201, a signal line driver circuit 202, a signal line driver circuit 203, data signal lines DL_1 to DL_Y (Y is a natural number of 2 or more), gate signal lines GL_1 to GL_X (X is a natural number of 2 or more), common signal lines CL_1 to CL_X, and a plurality of pixel circuits 210 arranged in X rows and Y columns.

The signal line driver circuit 201 has a function of generating a plurality of data signals DS (data signals DS_1 to DS_Y). The signal line driver circuit 201 has a function of controlling driving of the pixel circuit 210 by controlling the potentials of the plurality of data signal lines DL (data signal lines DL_1 to DL_Y) with the use of the plurality of data signals DS.

The signal line driver circuit 202 has a function of generating a plurality of gate signals GS (gate signals GS_1 to GS_X). The signal line driver circuit 202 has a function of controlling driving of the pixel circuit 210 by controlling the potentials of the plurality of gate signal lines GL (gate signal lines GL_1 to GL_X) with the use of the plurality of gate signals GS.

The signal line driver circuit 203 has a function of generating a plurality of common signals CS (common signals CS_1 to CS_X). The signal line driver circuit 203 has a function of controlling driving of the pixel circuit 210 by controlling the potentials of the plurality of common signal lines CL (common signal lines CL_1 to CL_X) with the use of the plurality of common signals CS.

The signal line driver circuit 203 can be the signal line driver circuit in Embodiment 1, for example.

The plurality of pixel circuits 210 each include a field-effect transistor 211, a liquid crystal element 212 including a pair of electrodes and a liquid crystal layer, and a capacitor 213. Note that the capacitor 213 is not necessarily provided.

In the pixel circuit 210 in the M-th row and the N-th column (M is a natural number smaller than or equal to X, and N is a natural number smaller than or equal to Y), one of a source and a drain of the field-effect transistor 211 is electrically connected to the data signal line DL_N (one of the plurality of data signal lines DL). In the pixel circuit 210 in the M-th row and the N-th column, a gate of the field-effect transistor 211 is electrically connected to the gate signal line GL_M (one of the plurality of gate signal lines GL).

In the pixel circuit 210 in the M-th row and the N-th column, one of the pair of electrodes of the liquid crystal element 212 is electrically connected to the other of the source and the drain of the field-effect transistor 211 of the pixel circuit 210 in the M-th row and the N-th column. In the pixel circuit 210 in the M-th row and the N-th column, the other of the pair of electrodes of the liquid crystal element 212 is electrically connected to the common signal line CL_M (one of the plurality of common signal lines CL).

In the liquid crystal element 212, the alignment of liquid crystal included in the liquid crystal layer is controlled in accordance with voltage applied to the pair of electrodes.

In the pixel circuit 210 in the M-th row and the N-th column, one of a pair of electrodes of the capacitor 213 is electrically connected to the other of the source and the drain of the field-effect transistor 211 in the pixel circuit 210 in the M-th row and the N-th column. In the pixel circuit 210 in the M-th row and the N-th column, the potential VSS is applied to the other of the pair of electrodes of the capacitor 213.

Next, an example of the configuration of the signal line driver circuit 203 will be described with reference to FIG. 7B.

Figure 7B:
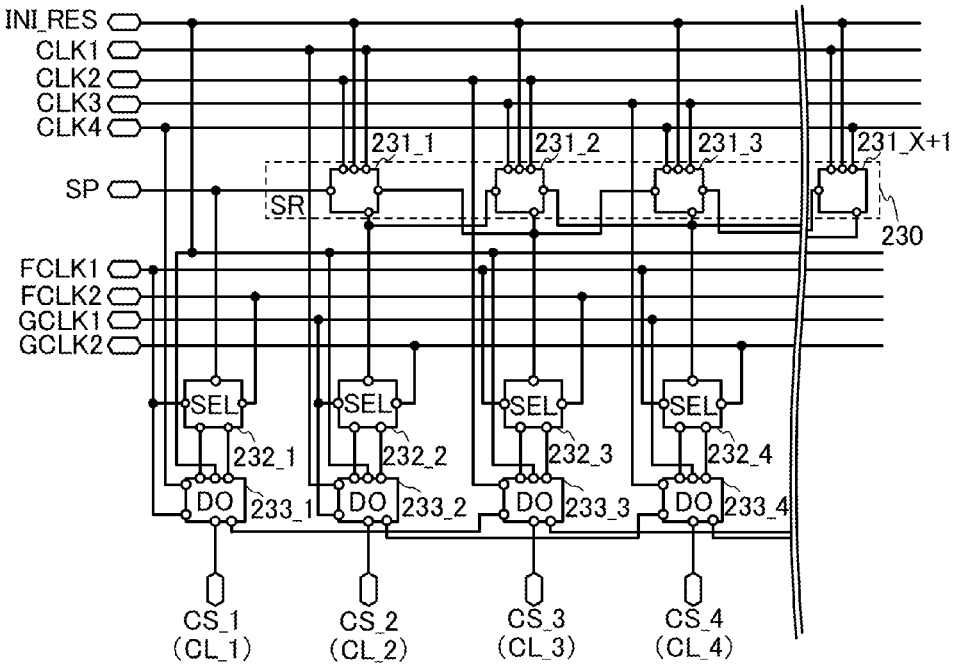

The signal line driver circuit 203 includes a shift register 230 (shift register 230 in FIG. 7B), a plurality of selection circuits 232 (in FIG. 7B, only selection circuits 232_1 to 232_4 are illustrated), and a plurality of driving signal output circuits 233 (in FIG. 7B, only driving signal output circuits 233_1 to 233_4 are illustrated). Further, the shift register 230 includes pulse output circuits 231_1 to 231_X. Note that in this embodiment, the case where the selection circuits 232_1 to 232_X and the driving signal output circuits 233_1 to 233_X are provided is described. Note that in FIGS. 7A and 7B, X is a natural number of 3 or more.

Further, each component of the signal line driver circuit illustrated in FIG. 7B is described with reference to FIGS. 8A and 8B, FIGS. 9A and 9B, and FIGS. 10A and 10B.

Figure 8A:
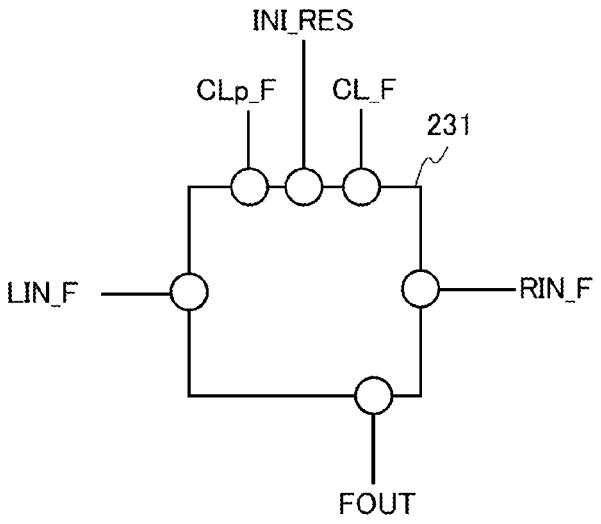
FIGS. 8A and 8B illustrate an example of a pulse output circuit.
Figure 8B:
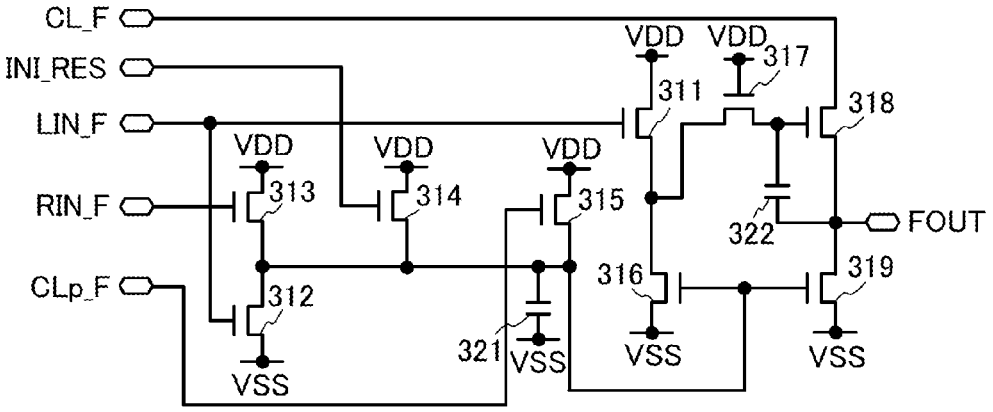

FIGS. 8A and 8B are diagrams for describing a configuration example of the pulse output circuit of the shift register 230 illustrated in FIG. 7B.

As illustrated in FIG. 8A, a set signal LIN_F, a reset signal RIN_F, a clock signal CL_F, a clock signal CLp_F, and an initialization signal INI_RES are input to the pulse output circuit 231. The pulse output circuit illustrated in FIG. 8A outputs a signal FOUT. The signal FOUT corresponds to a pulse signal SROUT of the shift register 230. Note that the initialization signal INI_RES is a signal used for initialization of the pulse output circuit, for example. A pulse of the initialization signal INI_RES is input to the pulse output circuit, whereby the pulse output circuit is initialized. Note that it is not always necessary to input the initialization signal INI_RES to the pulse output circuit.

Note that a configuration of a pulse output circuit 231_X+1 is the same as the other pulse output circuits, except that the reset signal RIN_F is not input.

The pulse output circuit 231 illustrated in FIG. 8A includes field-effect transistors 311 to 319, a capacitor 321, and a capacitor 322, as illustrated in FIG. 8B.

The potential VDD is applied to one of a source and a drain of the field-effect transistor 311. The set signal LIN_F is input to a gate of the field-effect transistor 311.

The potential VSS is applied to one of a source and a drain of the field-effect transistor 312. The set signal LIN_F is input to a gate of the field-effect transistor 312.

The potential VDD is applied to one of a source and a drain of the field-effect transistor 313. The other of the source and the drain of the field-effect transistor 313 is electrically connected to the other of the source and the drain of the field-effect transistor 312. The reset signal RIN_F is applied to a gate of the field-effect transistor 313.

The potential VDD is applied to one of a source and a drain of the field-effect transistor 314. The other of the source and the drain of the field-effect transistor 314 is electrically connected to the other of the source and the drain of the field-effect transistor 312. The initialization signal INI_RES is input to a gate of the field-effect transistor 314. Note that it is not always necessary to provide the field-effect transistor 314.

The potential VDD is applied to one of a source and a drain of the field-effect transistor 315. The other of the source and the drain of the field-effect transistor 315 is electrically connected to the other of the source and the drain of the field-effect transistor 312. The clock signal CLp_F is input to a gate of the field-effect transistor 315.

The potential VSS is applied to one of a source and a drain of the field-effect transistor 316. The other of the source and the drain of the field-effect transistor 316 is electrically connected to the other of the source and the drain of the field-effect transistor 311. A gate of the field-effect transistor 316 is electrically connected to the other of the source and the drain of the field-effect transistor 312.

One of a source and a drain of the field-effect transistor 317 is electrically connected to the other of the source and the drain of the field-effect transistor 311. The potential VDD is applied to a gate of the field-effect transistor 317.

The clock signal CL_F is input to one of a source and a drain of the field-effect transistor 318. A gate of the field-effect transistor 318 is electrically connected to the other of the source and the drain of the field-effect transistor 317. In the pulse output circuit in FIG. 8B, the potential of the other of the source and the drain of the field-effect transistor 318 corresponds to the potential of the signal FOUT.

The potential VSS is applied to one of a source and a drain of the field-effect transistor 319. The other of the source and the drain of the field-effect transistor 319 is electrically connected to the other of the source and the drain of the field-effect transistor 318. A gate of the field-effect transistor 319 is electrically connected to the other of the source and the drain of the field-effect transistor 312.

The potential VSS is applied to one of a pair of electrodes of the capacitor 321. The other of the pair of electrodes of the capacitor 321 is electrically connected to the other of the source and the drain of the field-effect transistor 312. It is not always necessary to provide the capacitor 321.

One of a pair of electrodes of the capacitor 322 is electrically connected to the gate of the field-effect transistor 318. The other of the pair of electrodes of the capacitor 322 is electrically connected to the other of the source and the drain of the field-effect transistor 318. It is not always necessary to provide the capacitor 322.

In the pulse output circuit illustrated in FIG. 8B, when the field-effect transistors 311 and 312 are turned on in accordance with the set signal LIN_F and the field-effect transistor 318 is turned on, the potential of the signal FOUT becomes substantially equal to the potential of the clock signal CL_F. In this case, the field-effect transistor 319 is in an off state. In the pulse output circuit illustrated in FIG. 8B, when the field-effect transistor 313 is turned on in accordance with the reset signal RIN_F and the field-effect transistor 319 is turned on, the potential of the signal FOUT becomes substantially equal to the potential VSS. In this case, since the field-effect transistor 313 is in an on state and the field-effect transistor 316 is in an on state, the field-effect transistor 318 is in an off state. Accordingly, the pulse output circuit outputs a pulse signal.

To the shift register 230 illustrated in FIG. 7B, a start pulse signal SP is input as the set signal LIN_F of the pulse output circuit 231_1.

Note that a wiring for inputting the start pulse signal SP to the signal line driver circuit 203 may be electrically connected to a protection circuit.

To the shift register 230, the signal FOUT of the pulse output circuit 231_K−1 is input as the set signal LIN_F of the pulse output circuit 231_K (K is a natural number larger than or equal to 2 and smaller than or equal to X).

To the shift register 230, the signal FOUT of the pulse output circuit 231_M+1 is input as the reset signal RIN_F of the pulse output circuit 231_M.

To the pulse output circuit 231_1 of the shift register 230, a clock signal CLK1 and a clock signal CLK2 are input as the clock signal CL_F and the clock signal CLp_F, respectively. The clock signal CLK1 is input as the clock signal CL_F and the clock signal CLK2 is input as the clock signal CLp_F to every fourth pulse output circuit from the pulse output circuit 231_1.

To the pulse output circuit 231_2 of the shift register 230, the clock signal CLK2 and a clock signal CLK3 are input as the clock signal CL_F and the clock signal CLp_F, respectively. The clock signal CLK2 is input as the clock signal CL_F and the clock signal CLK3 is input as the clock signal CLp_F to every fourth pulse output circuit from the pulse output circuit 231_2.

To the pulse output circuit 231_3 of the shift register 230, the clock signal CLK3 and the clock signal CLK4 are input as the clock signal CL_F and the clock signal CLp_F, respectively. The clock signal CLK3 is input as the clock signal CL_F and the clock signal CLK4 is input as the clock signal CLp_F to every fourth pulse output circuit from the pulse output circuit 231_3.

To the pulse output circuit 231_4 of the shift register 230, the clock signal CLK4 and the clock signal CLK1 are input as the clock signal CL_F and the clock signal CLp_F, respectively. The clock signal CLK4 is input as the clock signal CL_F and the clock signal CLK1 is input as the clock signal CLp_F to every fourth pulse output circuit from the pulse output circuit 231_4.

Note that each of wirings for inputting the clock signals CLK1 to CLK4 may be electrically connected to a protection circuit.

The above is the description of a pulse output circuit.

Figure 9A:
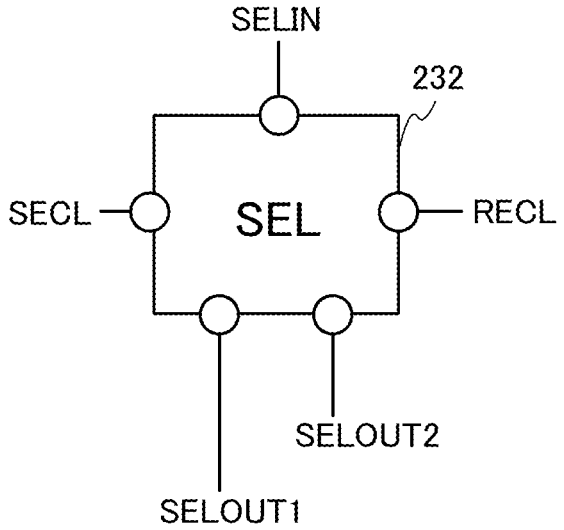
FIGS. 9A and 9B illustrate an example of a selection circuit.
Figure 9B:
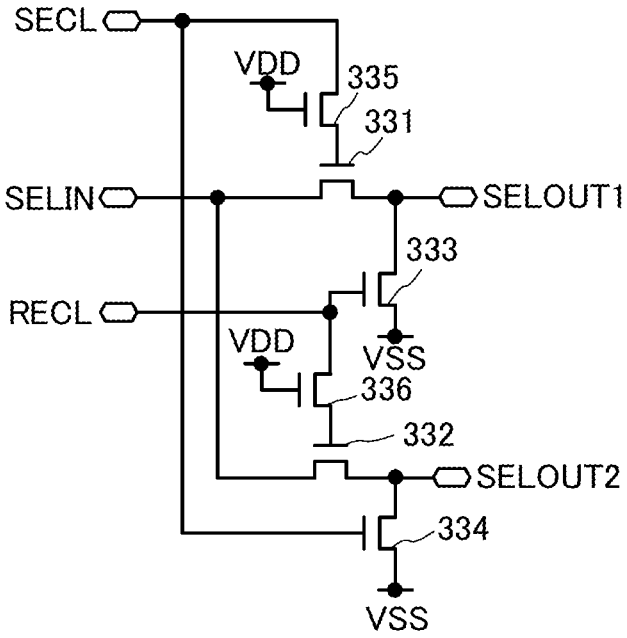

FIGS. 9A and 9B are diagrams for describing an example of a configuration of the selection circuit.

A pulse signal SELIN, a clock signal SECL, and a clock signal RECL are input to the selection circuit 232, as illustrated in FIG. 9A. The selection circuit 232 outputs a pulse signal SELOUT1 and a pulse signal SELOUT2. The selection circuit 232 has a function of determining which the pulse signal SELOUT1 or the pulse signal SELOUT2 is output at the same potential level as the pulse signal SELIN in accordance with the clock signal SECL and the clock signal RECL.

The selection circuit 232 illustrated in FIG. 9A includes field-effect transistors 331 to 336 as illustrated in FIG. 9B.

The pulse signal SELIN is input to one of a source and a drain of the field-effect transistor 331. The potential of the other of the source and the drain of the field-effect transistor 331 corresponds to the potential of the pulse signal SELOUT1.

The pulse signal SELIN is input to one of a source and a drain of the field-effect transistor 332. The potential of the other of the source and the drain of the field-effect transistor 332 corresponds to the potential of the pulse signal SELOUT2.

The potential VSS is applied to one of a source and a drain of the field-effect transistor 333. The other of the source and the drain of the field-effect transistor 333 is electrically connected to the other of the source and the drain of the field-effect transistor 331. The clock signal RECL is input to a gate of the field-effect transistor 333.

The potential VSS is applied to one of a source and a drain of the field-effect transistor 334. The other of the source and the drain of the field-effect transistor 334 is electrically connected to the other of the source and the drain of the field-effect transistor 332. The clock signal SECL is input to a gate of the field-effect transistor 334.

The clock signal SECL is input to one of a source and a drain of the field-effect transistor 335. The other of the source and the drain of the field-effect transistor 335 is electrically connected to a gate of the field-effect transistor 331. The potential VDD is applied to a gate of the field-effect transistor 335. Note that it is not always necessary to provide the field-effect transistor 335.

The clock signal RECL is input to one of a source and a drain of the field-effect transistor 336. The other of the source and the drain of the field-effect transistor 336 is electrically connected to a gate of the field-effect transistor 332. The potential VDD is applied to a gate of the field-effect transistor 336. It is not always necessary to provide the field-effect transistor 336.

In the selection circuit illustrated in FIG. 9B, the pulse signal SELIN is output as the pulse signal SELOUT1 by turning on the field-effect transistor 331 in accordance with the clock signal SECL. At this time, the field-effect transistor 332 is in an off state and the field-effect transistor 334 is in an on state. In the selection circuit illustrated in FIG. 9B, the pulse signal SELIN is output as the pulse signal SELOUT2 by turning on the field-effect transistor 332 in accordance with the clock signal RECL. At this time, the field-effect transistor 331 is in an off state and the field-effect transistor 333 is in an on state.

A start pulse signal SP is input as the pulse signal SELIN of the selection circuit 232_1 illustrated in FIG. 7B.

The signal FOUT of the pulse output circuit 231_K−1 is input as the pulse signal SELIN of the selection circuit 232_K.

The clock signal FCLK1 is input as the clock signal SECL of the selection circuit 232_Q (Q is an odd number larger than or equal to 1 and smaller than or equal to X).

The clock signal FCLK2 is input as the clock signal RECL of the selection circuit 232_Q.

The clock signal GCLK1 is input as the clock signal SECL of the selection circuit 232_R (R is an even number larger than or equal to 2 and smaller than or equal to X).

The clock signal GCLK2 is input as the clock signal RECL of the selection circuit 232_R.

Note that each of wirings for inputting FCLK1, the clock signal FCLK2, the clock signal GCLK1, and the clock signal GCLK2 may be electrically connected to a protection circuit.

The above is the description of the selection circuit.

Figure 10A:
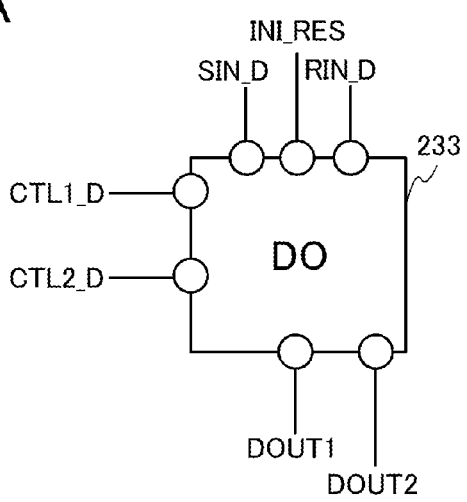
FIGS. 10A and 10B illustrate an example of a driving signal output circuit.
Figure 10B:
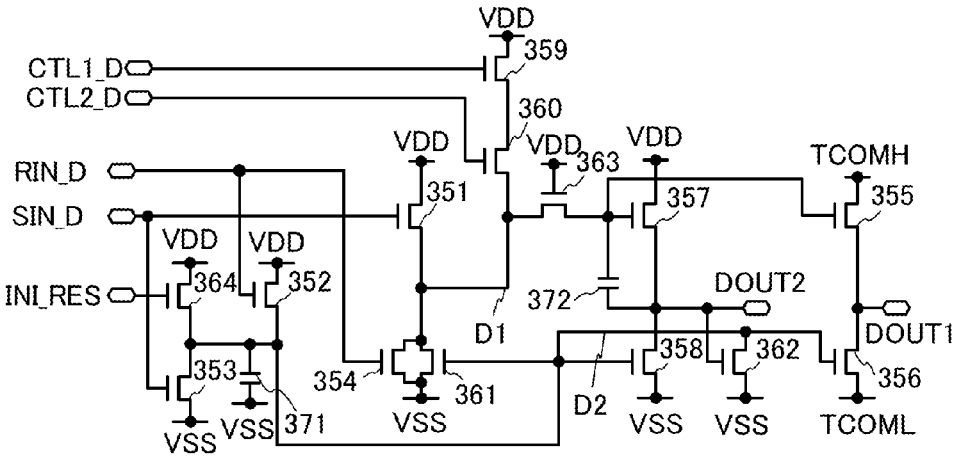

FIGS. 10A and 10B are diagrams for describing an example of the driving signal output circuit.

As illustrated in FIG. 10A, a set signal SIN_D, a reset signal RIN_D, a control signal CTL1_D, a control signal CTL2_D, and an initialization signal INI_RES are input to the driving signal output circuit 233. By inputting a pulse of the initialization signal INI_RES to the driving signal output circuit, the driving signal output circuit 233 is initialized. Note that it is not always necessary to input the initialization signal INI_RES to the driving signal output circuit 233. The driving signal output circuit 233 outputs a signal DOUT1 and a signal DOUT2. The signal DOUT1 is a common signal output from the driving signal output circuit 233. A wiring for outputting the signal DOUT1 may be electrically connected to a protection circuit. The driving signal output circuit 233 illustrated in FIG. 10A includes a latch unit, a first buffer unit, a second buffer unit, and a switch unit, similarly to the driving signal output circuit illustrated in FIGS. 3A and 3B. The further details are described below.

As shown in FIG. 10B, the driving signal output circuit 233 illustrated in FIG. 10A includes field-effect transistors 351 to 364, a capacitor 371, and a capacitor 372. Note that the field-effect transistors 351 to 364 are n-channel transistors.

The field-effect transistor 351 is provided in the latch unit. The potential VDD is applied to one of a source and a drain of the field-effect transistor 351. The set signal SIN_D is input to a gate of the field-effect transistor 351.

The field-effect transistor 352 is provided in the latch unit. The potential VDD is applied to one of a source and a drain of the field-effect transistor 352. The reset signal RIN_D is input to a gate of the field-effect transistor 352.

The field-effect transistor 353 is provided in the latch unit. The potential VSS is applied to one of a source and a drain of the field-effect transistor 353. The other of the source and the drain of the field-effect transistor 353 is electrically connected to the other of the source and the drain of the field-effect transistor 352. The set signal SIN_D is input to a gate of the field-effect transistor 353.

The field-effect transistor 354 is provided in the latch unit. The potential VSS is applied to one of a source and a drain of the field-effect transistor 354. The other of the source and the drain of the field-effect transistor 354 is electrically connected to the other of the source and the drain of the field-effect transistor 351. The reset signal RIN_D is input to a gate of the field-effect transistor 354.

The field-effect transistor 355 is provided in the first buffer unit. A potential TCOMH is applied to one of a source and a drain of the field-effect transistor 355. The potential of the other of the source and the drain of the field-effect transistor 355 corresponds to the potential of the signal DOUT1.

The field-effect transistor 356 is provided in the first buffer unit. A potential TCOML is applied to one of a source and a drain of the field-effect transistor 356. The other of the source and the drain of the field-effect transistor 356 is electrically connected to the other of the source and the drain of the field-effect transistor 355. A gate of the field-effect transistor 356 is electrically connected to the other of the source and the drain of the field-effect transistor 352.

Each of the potential TCOMH and the potential TCOML is a potential for setting the potential of a common signal. The potential TCOMH is higher than the potential TCOML.

The field-effect transistor 357 is provided in the second buffer unit. The potential VDD is applied to one of a source and a drain of the field-effect transistor 357. The potential of the other of the source and the drain of the field-effect transistor 357 corresponds to the potential of the signal DOUT2.

The field-effect transistor 358 is provided in the second buffer unit. The potential VSS is applied to one of a source and a drain of the field-effect transistor 358. The other of the source and the drain of the field-effect transistor 358 is electrically connected to the other of the source and the drain of the field-effect transistor 357. A gate of the field-effect transistor 358 is electrically connected to the other of the source and the drain of the field-effect transistor 352.

The field-effect transistor 359 is provided in the switch unit. The potential VDD is applied to one of a source and a drain of the field-effect transistor 359. The control signal CTL1_D is input to a gate of the field-effect transistor 359.

The field-effect transistor 360 is provided in the switch unit. One of a source and a drain of the field-effect transistor 360 is electrically connected to the other of the source and the drain of the field-effect transistor 359. The other of the source and the drain of the field-effect transistor 360 is electrically connected to the other of the source and the drain of the field-effect transistor 351. The control signal CTL2_D is input to a gate of the field-effect transistor 360.

The potential VSS is applied to one of a source and a drain of the field-effect transistor 361. The other of the source and the drain of the field-effect transistor 361 is electrically connected to the other of the source and the drain of the field-effect transistor 351. A gate of the field-effect transistor 361 is electrically connected to the other of the source and the drain of the field-effect transistor 352. Note that it is not always necessary to provide the field-effect transistor 361.

The potential VSS is applied to one of a source and a drain of the field-effect transistor 362. The other of the source and the drain of the field-effect transistor 362 is electrically connected to the other of the source and the drain of the field-effect transistor 352. A gate of the field-effect transistor 362 is electrically connected to the other of the source and the drain of the field-effect transistor 357. Note that it is not always necessary to provide the field-effect transistor 362.

One of a source and a drain of the field-effect transistor 363 is electrically connected to the other of the source and the drain of the field-effect transistor 351. The other of the source and the drain of the field-effect transistor 363 is electrically connected to a gate of the field-effect transistor 355 and a gate of the field-effect transistor 357. The potential VDD is applied to a gate of the field-effect transistor 363. Note that it is not always necessary to provide the field-effect transistor 363.

The potential VDD is applied to one of a source and a drain of the field-effect transistor 364. The other of the source and the drain of the field-effect transistor 364 is electrically connected to the gate of the field-effect transistor 356 and the gate of the field-effect transistor 358. The initialization signal INI_RES is input to a gate of the field-effect transistor 364. Note that it is not always necessary to provide the field-effect transistor 364.

The potential VSS is applied to one of a pair of electrodes of the capacitor 371. The other of the pair of electrodes of the capacitor 371 is electrically connected to the gate of the field-effect transistor 356 and the gate of the field-effect transistor 358. Note that it is not always necessary to provide the capacitor 371.

One of a pair of electrodes of the capacitor 372 is electrically connected to the gate of the field-effect transistor 355 and the gate of the field-effect transistor 357. The other of the pair of electrodes of the capacitor 372 is electrically connected to the other of the source and the drain of the field-effect transistor 357. Note that it is not always necessary to provide the capacitor 372.

In the driving signal output circuit illustrated in FIG. 10B, by turning on the field-effect transistors 351 and 353 in accordance with the set signal SIN_D and turning on the field-effect transistor 355, the potential of the signal DOUT1 becomes substantially equal to the potential TCOMH. In this case, the field-effect transistor 356 is in an off state. In the driving signal output circuit illustrated in FIG. 10B, by turning on the field-effect transistors 352 and 354 in accordance with the reset signal RIN_D and turning on the field-effect transistor 356, the potential of the signal DOUT1 becomes substantially equal to the potential TCOML. In this case, the field-effect transistor 355 is in an off state.

The pulse signal SELOUT1 of the selection circuit 232_M is input as the set signal SIN_D of the driving signal output circuit 233_M illustrated in FIG. 7B.

The pulse signal SELOUT2 of the selection circuit 232_M is input as the reset signal RIN_D of the driving signal output circuit 233_M.

The clock signal CLK4 is input as the control signal CTL1_D of the driving signal output circuit 233_1. The clock signal CLK4 is input as the control signal CTL1_D to every fourth driving signal output circuit from the driving signal output circuit 233_1.

The clock signal CLK1 is input as the control signal CTL1_D of the driving signal output circuit 233_2. The clock signal CLK1 is input as the control signal CTL1_D to every fourth driving signal output circuit from the driving signal output circuit 233_2.

The clock signal CLK2 is input as the control signal CTL1_D of the driving signal output circuit 233_3. The clock signal CLK2 is input as the control signal CTL1_D to every the fourth driving signal output circuit from the driving signal output circuit 233_3.

The clock signal CLK3 is input as the control signal CTL1_D of the driving signal output circuit 233_4. The clock signal CLK3 is input as the control signal CTL1_D to every the fourth driving signal output circuit from the driving signal output circuit 233_4.

The clock signal FCLK1 is input as the control signal CTL2_D of the driving signal output circuit 233_1.

The clock signal GCLK1 is input as the control signal CTL2_D of the driving signal output circuit 233_2.

The signal DOUT2 of the driving signal output circuit 233_L−2 (L is a natural number larger than or equal to 3 and smaller than or equal to X) is input as the control signal CTL2_D of the driving signal output circuit 233_L.

The signal DOUT1 of the driving signal output circuit 233_M corresponds to the common signal CS_M.

The above is the description of the signal line driver circuit illustrated in FIG. 7B.

Figure 11A:
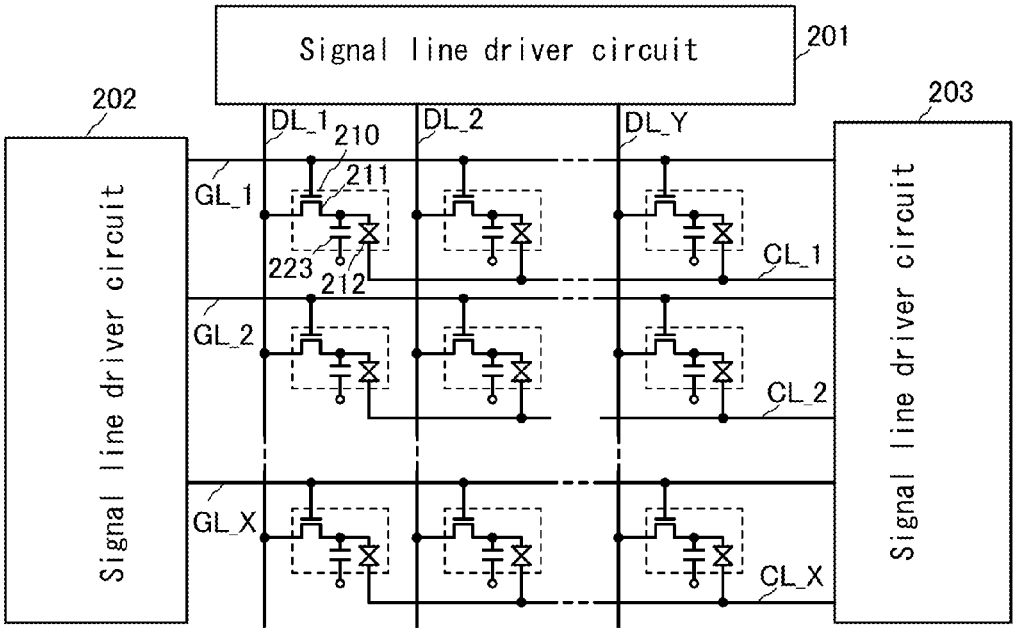
FIGS. 11A and 11B illustrate an example of a liquid crystal display device.

A liquid crystal display device of this embodiment can have a configuration illustrated in FIG. 11A. The liquid crystal display device illustrated in FIG. 11A has a configuration in which the plurality of gate signal lines GL and the plurality of common signal lines CL are electrically connected to the signal line driver circuit 203.

Figure 11B:
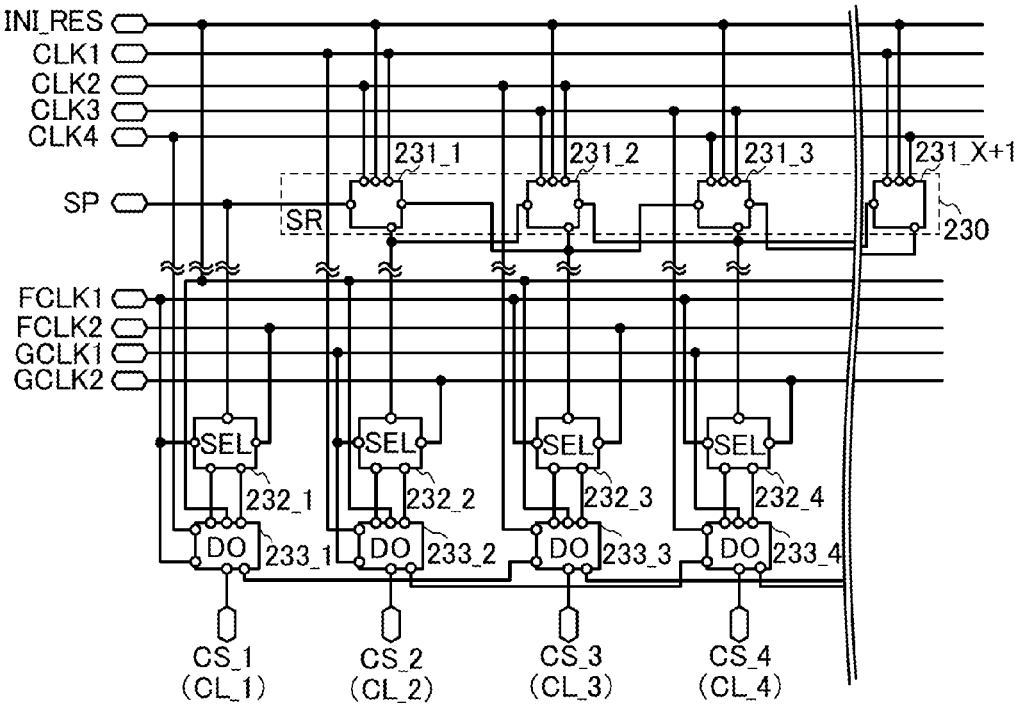

FIG. 11B illustrates an example of a configuration of the signal line driver circuit 203 in this case. The shift register 230 illustrated in FIG. 11B is provided in the signal line driver circuit 202. The plurality of selection circuits 232 and the plurality of driving signal output circuits 233 are provided for the signal line driver circuit 203. With this configuration, even when shift registers are not provided in the signal line driver circuit 203, the pulse signal SROUT can be output to the selection circuit 232 of the signal line driver circuit 203 with the shift register 230 of the signal line driver circuit 202.

Figure 12A:
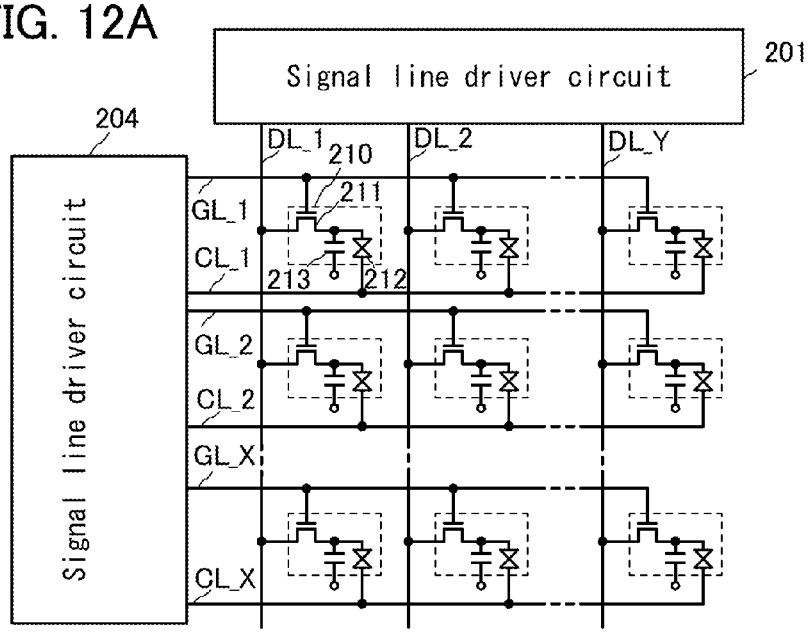
FIGS. 12A and 12B illustrate an example of a liquid crystal display device.

The liquid crystal display device of this embodiment can have a configuration illustrated in FIG. 12A. The liquid crystal display device illustrated in FIG. 12A includes a signal line driver circuit 204, instead of the signal line driver circuit 202 and the signal line driver circuit 203.

Figure 12B:
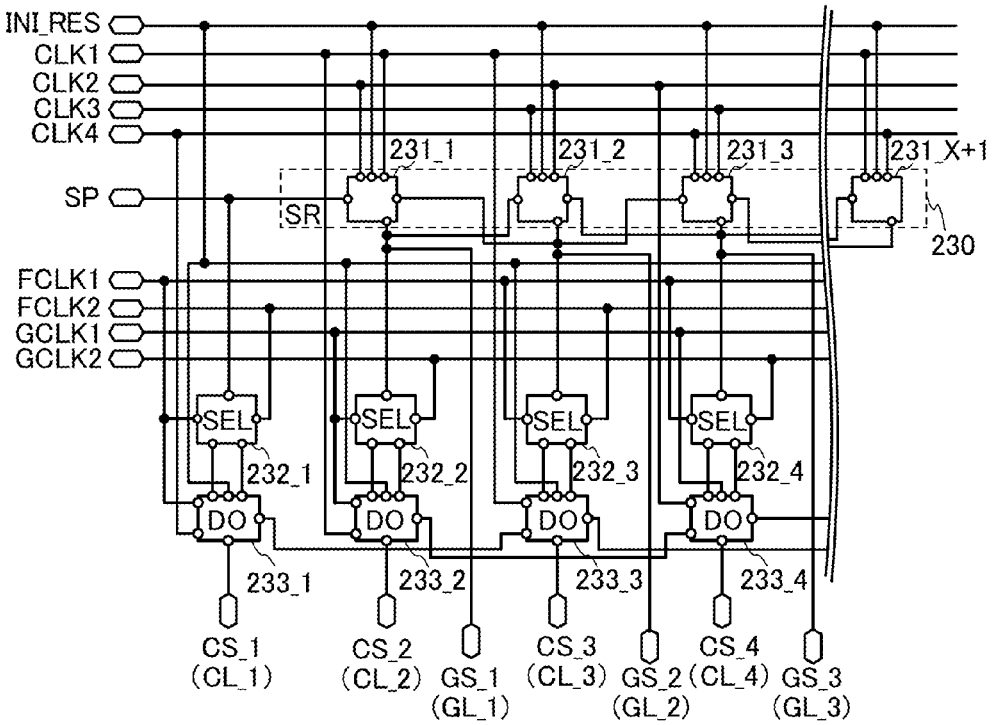

FIG. 12B illustrates an example of a configuration of the signal line driver circuit 204. The signal line driver circuit 204 illustrated in FIG. 12B has the configuration of the signal line driver circuit illustrated in FIG. 7B and has a function of outputting the gate signals GS_1 to GS_X.

In the signal line driver circuit illustrated in FIG. 12B, the signal FOUT of the pulse output circuit 231_M corresponds to the gate signal GS_M.

Figure 13:
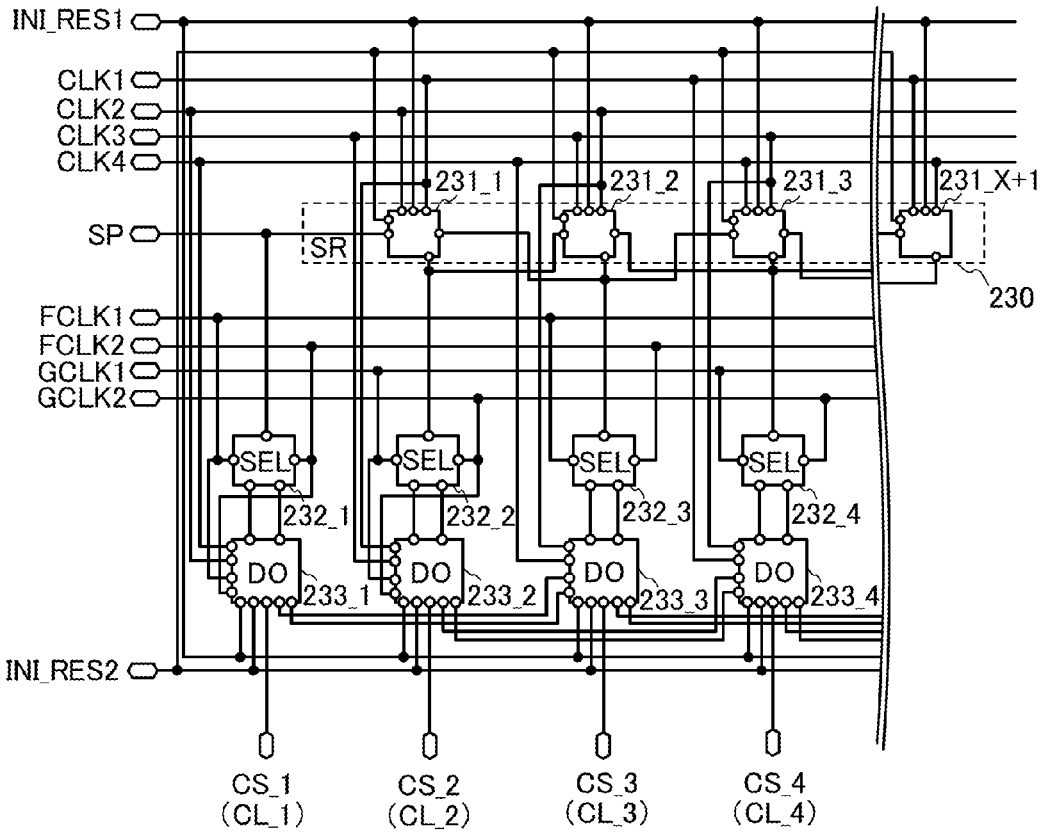
FIG. 13 illustrates an example of a signal line driver circuit.

The signal line driver circuit illustrated in FIG. 7B can have another configuration. FIG. 13 illustrates another example of the configuration of the signal line driver circuit illustrated in FIG. 7B.

A signal line driver circuit illustrated in FIG. 13 and the signal line driver circuit illustrated in FIG. 7B are different in a configuration of a pulse output circuit of a shift register and a configuration of a driving signal output circuit.

An example of the configuration of the pulse output circuit illustrated in FIG. 13 is described with reference to FIGS. 14A and 14B.

Figure 14A:
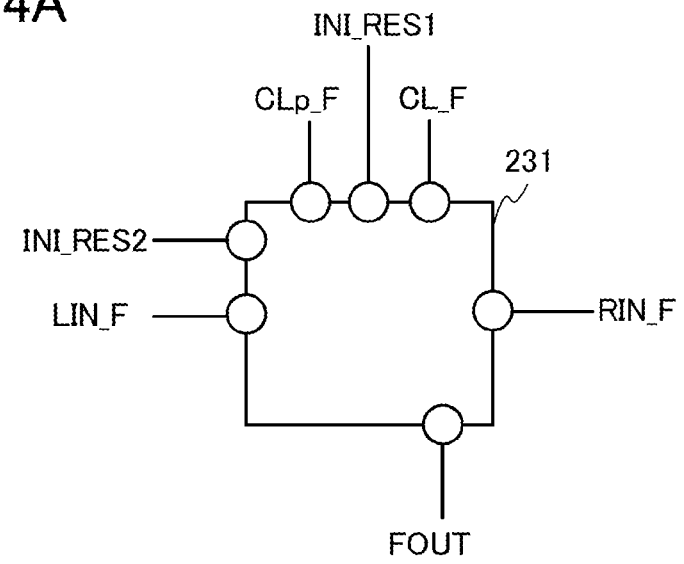
FIGS. 14A and 14B illustrate an example of a pulse output circuit.

To the pulse output circuit 231 illustrated in FIG. 14A, an initialization signal INI_RES1 and an initialization signal INI_RES2 are input instead of the initialization signal INI_RES. The initialization signals INI_RES1 and INI_RES2 are used in the case where the potentials of a plurality of connection portions in a circuit are separately initialized, for example. Pulses of the initialization signals INI_RES1 and INI_RES2 are input to the pulse output circuit, whereby the pulse output circuit is initialized. Note that the initialization signals INI_RES1 and INI_RES2 have different waveforms. It is not always necessary to input the initialization signals INI_RES1 and INI_RES2 to the pulse output circuit.

Figure 14B:
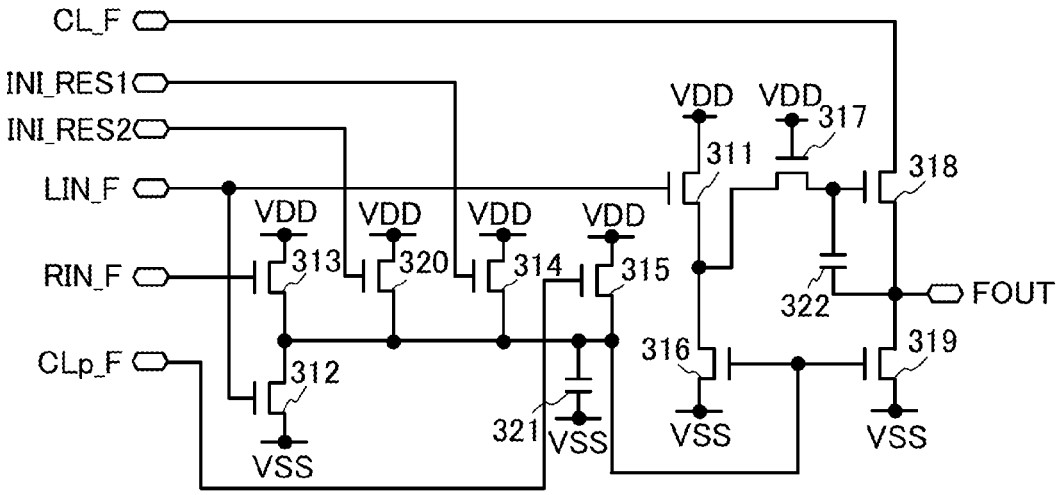

Further, the pulse output circuit illustrated in FIG. 14A has a field-effect transistor 320 in addition to the configuration of the pulse output circuit illustrated in FIG. 8B, as shown in FIG. 14B.

The potential VDD is applied to one of a source and a drain of the field-effect transistor 320. The other of the source and the drain of the field-effect transistor 320 is electrically connected to the gate of the field-effect transistor 319. The initialization signal INI_RES2 is input to a gate of the field-effect transistor 320.

In the pulse output circuit illustrated in FIG. 14B, the initialization signal INI_RES1 is input to the gate of the field-effect transistor 314, instead of the initialization signal INI_RES.

The above is the description of the pulse output circuit illustrated in FIG. 13.

An example of a configuration of the driving signal output circuit illustrated in FIG. 13 is described with reference to FIGS. 15A and 15B.

Figure 15A:
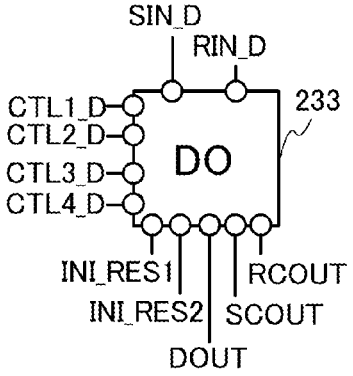
FIGS. 15A and 15B illustrate an example of a driving signal output circuit.

A set signal SIN_D, a reset signal RIN_D, control signals CTL1_D to CTL4_D, and initialization signals INI_RES1 and INI_RES2 are input to the driving signal output circuit 233 in FIG. 15A. Pulses of the initialization signals INI_RES1 and INI_RES2 are input to the driving signal output circuit, whereby the driving signal output circuit is initialized. It is not always necessary to input the initialization signals INI_RES1 and INI_RES2 are input to the driving signal output circuit. As illustrated in FIG. 15A, the plurality of driving signal output circuits 233 illustrated in FIG. 13 each have a function of outputting a signal SCOUT, a signal RCOUT, and a signal DOUT. The signal DOUT is a common signal.

The driving signal output circuit illustrated in FIG. 15A includes a first latch unit storing the data D11 and the data D22, a second latch unit storing the data D13 and the data D24, a first buffer unit, a second buffer unit, a first switch unit, a second switch unit, a third switch unit, a fourth switch unit, and a third buffer unit. The further details are described below.

Figure 15B:
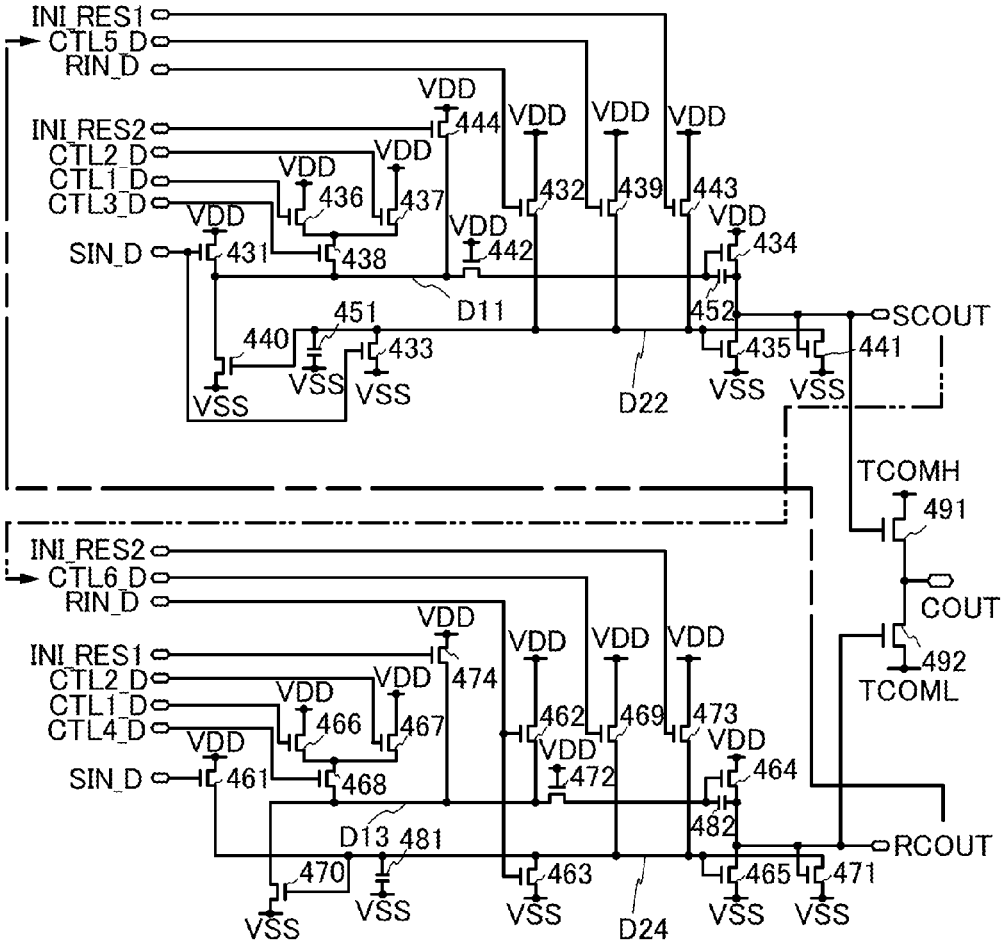

The driving signal output circuit illustrated in FIG. 15A includes field-effect transistors 431 to 444, a capacitor 451, a capacitor 452, field-effect transistors 461 to 474, a capacitor 481, and a capacitor 482, as illustrated in FIG. 15B.

The field-effect transistor 431 is provided in the first latch unit. The field-effect transistor 461 is provided in the second latch unit. The potential VDD is applied to one of a source and a drain of the field-effect transistor 431 and one of a source and a drain of the field-effect transistor 461. The set signal SIN_D is input to a gate of the field-effect transistor 431 and a gate of the field-effect transistor 461. The potential of the other of the source and the drain of the field-effect transistor 431 corresponds to the data D11. The potential of the other of the source and the drain of the field-effect transistor 461 corresponds to the data D24.

The field-effect transistor 432 is provided in the first latch unit. The field-effect transistor 462 is provided in the second latch unit. The potential VDD is applied to one of a source and a drain of the field-effect transistor 432 and one of a source and a drain of the field-effect transistor 462. The reset signal RIN_D is input to a gate of the field-effect transistor 432 and a gate of the field-effect transistor 462. The potential of the other of the source and the drain of the field-effect transistor 432 corresponds to the data D22. The potential of the other of the source and the drain of the field-effect transistor 462 corresponds to the data D13.

The field-effect transistor 433 is provided in the first latch unit. The potential VSS is applied to one of a source and a drain of the field-effect transistor 433. The other of the source and the drain of the field-effect transistor 433 is electrically connected to the other of the source and the drain of the field-effect transistor 432. The set signal SIN_D is input to a gate of the field-effect transistor 433.

The field-effect transistor 463 is provided in the second latch unit. The potential VSS is applied to one of a source and a drain of the field-effect transistor 463. The other of the source and the drain of the field-effect transistor 463 is electrically connected to the other of the source and the drain of the field-effect transistor 461. The reset signal RIN_D is input to a gate of the field-effect transistor 463.

The field-effect transistor 434 is provided in the first buffer unit. The field-effect transistor 464 is provided in the second buffer unit. The potential VDD is applied to one of a source and a drain of the field-effect transistor 434 and one of a source and a drain of the field-effect transistor 464. The potential of the other of the source and the drain of the field-effect transistor 434 corresponds to the potential of the signal SCOUT. The potential of the other of the source and the drain of the field-effect transistor 464 corresponds to the potential of the signal RCOUT.

The field-effect transistor 435 is provided in the first buffer unit. The field-effect transistor 465 is provided in the second buffer unit. The potential VSS is applied to one of a source and a drain of the field-effect transistor 435 and one of a source and a drain of the field-effect transistor 465. The other of the source and the drain of the field-effect transistor 435 is electrically connected to the other of the source and the drain of the field-effect transistor 434. The other of the source and the drain of the field-effect transistor 465 is electrically connected to the other of the source and the drain of the field-effect transistor 464.

The field-effect transistor 436 is provided in the first switch unit. The field-effect transistor 466 is provided in the second switch unit. The potential VDD is applied to one of a source and a drain of the field-effect transistor 436 and one of a source and a drain of the field-effect transistor 466. The control signal CTL1_D is input to a gate of the field-effect transistor 436 and a gate of the field-effect transistor 466.

The field-effect transistor 437 is provided in the first switch unit. The field-effect transistor 467 is provided in the second switch unit. The potential VDD is applied to one of a source and a drain of the field-effect transistor 437 and one of a source and a drain of the field-effect transistor 467. The control signal CTL2_D is input to a gate of the field-effect transistor 437 and a gate of the field-effect transistor 467.

The field-effect transistor 438 is provided in the first switch unit. One of a source and a drain of the field-effect transistor 438 is electrically connected to the other of the source and the drain of the field-effect transistor 436 and the other of the source and the drain of the field-effect transistor 437. The other of the source and the drain of the field-effect transistor 438 is electrically connected to the other of the source and the drain of the field-effect transistor 431. The control signal CTL3_D is input to a gate of the field-effect transistor 438.

The field-effect transistor 468 is provided in the second switch unit. One of a source and a drain of the field-effect transistor 468 is electrically connected to the other of the source and the drain of the field-effect transistor 466 and the other of the source and the drain of the field-effect transistor 467. The other of the source and the drain of the field-effect transistor 468 is electrically connected to the other of the source and the drain of the field-effect transistor 462. The control signal CTL4_D is input to a gate of the field-effect transistor 468.

The field-effect transistor 439 is provided in the third switch unit. The potential VDD is applied to one of a source and a drain of the field-effect transistor 439. The other of the source and the drain of the field-effect transistor 439 is electrically connected to the other of the source and the drain of the field-effect transistor 432. The signal RCOUT is input to a gate of the field-effect transistor 439 as the control signal CTL5_D.

The field-effect transistor 469 is provided in the fourth switch unit. The potential VDD is applied to one of a source and a drain of the field-effect transistor 469. The other of the source and the drain of the field-effect transistor 469 is electrically connected to the other of the source and the drain of the field-effect transistor 461. The signal SCOUT is input to a gate of the field-effect transistor 469 as a control signal CTL6_D.

The potential VSS is applied to one of a source and a drain of the field-effect transistor 440. The other of the source and the drain of the field-effect transistor 440 is electrically connected to the other of the source and the drain of the field-effect transistor 431. A gate of the field-effect transistor 440 is electrically connected to the other of the source and the drain of the field-effect transistor 432.

The potential VSS is applied to one of a source and a drain of the field-effect transistor 470. The other of the source and the drain of the field-effect transistor 470 is electrically connected to the other of the source and the drain of the field-effect transistor 462. A gate of the field-effect transistor 470 is electrically connected to the other of the source and the drain of the field-effect transistor 461.

The potential VSS is applied to one of a source and a drain of the field-effect transistor 441. The other of the source and the drain of the field-effect transistor 441 is electrically connected to the other of the source and the drain of the field-effect transistor 432. A gate of the field-effect transistor 441 is electrically connected to the other of the source and the drain of the field-effect transistor 434. It is not always necessary to provide the field-effect transistor 441.

The potential VSS is applied to one of a source and a drain of the field-effect transistor 471. The other of the source and the drain of the field-effect transistor 471 is electrically connected to the other of the source and the drain of the field-effect transistor 463. A gate of the field-effect transistor 471 is electrically connected to the other of the source and the drain of the field-effect transistor 464. It is not always necessary to provide the field-effect transistor 471.

One of a source and a drain of the field-effect transistor 442 is electrically connected to the other of the source and the drain of the field-effect transistor 431. The other of the source and the drain of the field-effect transistor 442 is electrically connected to a gate of the field-effect transistor 434. The potential VDD is applied to a gate of the field-effect transistor 442. It is not always necessary to provide the field-effect transistor 442.

One of a source and a drain of the field-effect transistor 472 is electrically connected to the other of the source and the drain of the field-effect transistor 462. The other of the source and the drain of the field-effect transistor 472 is electrically connected to a gate of the field-effect transistor 464. The potential VDD is applied to a gate of the field-effect transistor 472. It is not always necessary to provide the field-effect transistor 472.

The potential VDD is applied to one of a source and a drain of the field-effect transistor 443 and one of a source and a drain of the field-effect transistor 473. The other of the source and the drain of the field-effect transistor 443 is electrically connected to a gate of the field-effect transistor 435. The other of the source and the drain of the field-effect transistor 473 is electrically connected to a gate of the field-effect transistor 465. The initialization signal INI_RES1 is input to a gate of the field-effect transistor 443. The initialization signal INI_RES2 is input to a gate of the field-effect transistor 473. It is not always necessary to provide the field-effect transistor 443 and the field-effect transistor 473.

The potential VDD is applied to one of a source and a drain of the field-effect transistor 444 and one of a source and a drain of the field-effect transistor 474. The other of the source and the drain of the field-effect transistor 444 is electrically connected to the other of the source and the drain of the field-effect transistor 431. The other of the source and the drain of the field-effect transistor 474 is electrically connected to the other of the source and the drain of the field-effect transistor 462. The initialization signal INI_RES2 is input to a gate of the field-effect transistor 444. The initialization signal INI_RES1 is input to a gate of the field-effect transistor 474. It is not always necessary to provide the field-effect transistor 444 and the field-effect transistor 474.

The potential VSS is applied to one of a pair of electrodes of the capacitor 451. The other of the pair of electrodes of the capacitor 451 is electrically connected to the gate of the field-effect transistor 435.

The potential VSS is applied to one of a pair of electrodes of the capacitor 481. The other of the pair of electrodes of the capacitor 481 is electrically connected to the gate of the field-effect transistor 465.

One of a pair of electrodes of the capacitor 452 is electrically connected to the gate of the field-effect transistor 434. The other of the pair of electrodes of the capacitor 452 is electrically connected to the other of the source and the drain of the field-effect transistor 434.

One of a pair of electrodes of the capacitor 482 is electrically connected to the gate of the field-effect transistor 464. The other of the pair of electrodes of the capacitor 482 is electrically connected to the other of the source and the drain of the field-effect transistor 464.

Note that it is not always necessary to provide the capacitor 451, the capacitor 452, the capacitor 481, and the capacitor 482.

A field-effect transistor 491 is provided in the third buffer unit. The potential TCOMH is applied to one of a source and a drain of the field-effect transistor 491. The potential TCOMH is higher than the potential VDD. The potential of the other of the source and the drain of the field-effect transistor 491 corresponds to the potential of a signal COUT. The signal SCOUT is input to a gate of the field-effect transistor 491.

The field-effect transistor 492 is provided in the third buffer unit. The potential TCOML is applied to one of a source and a drain of the field-effect transistor 492. The potential TCOML is lower than the potential VSS. The other of the source and the drain of the field-effect transistor 492 is electrically connected to the other of the source and the drain of the field-effect transistor 491. The signal RCOUT is input to a gate of the field-effect transistor 492.

In the driving signal output circuit illustrated in FIG. 15B, the field-effect transistor 431 and the field-effect transistor 433 are turned on in accordance with the set signal SIN_D, the potential VDD is written as the data D11 of the first latch unit, the field-effect transistor 434 is turned on, the potential of the signal SCOUT becomes the potential VH, and the signal SCOUT becomes high level. In this case, the potential VSS is written as the data D22 of the first latch unit, and thus the field-effect transistor 435 is in an off state. The field-effect transistor 461 is turned on in accordance with the set signal SIN_D, the potential VDD is written as the data D24 of the second latch unit, the field-effect transistor 465 is turned on, the potential of the signal RCOUT becomes the potential VL, and the signal RCOUT becomes low level. In this case, the field-effect transistor 464 is in an off state.

In the driving signal output circuit illustrated in FIG. 15B, the field-effect transistor 432 is turned on in accordance with the reset signal RIN_D, the potential VDD is written as the data D22 of the first latch unit, the field-effect transistor 435 is turned on, the potential of the signal SCOUT becomes the potential VL, and the signal SCOUT becomes low level. In this case, the field-effect transistor 440 is in an on state and the field-effect transistor 431 is in an off state; accordingly, the field-effect transistor 434 is in an off state. The field-effect transistor 462 is turned on in accordance with the reset signal RIN_D, the field-effect transistor 464 is turned on, the potential of the signal RCOUT becomes the potential VH, and the signal RCOUT becomes high level. In this case, the potential VSS is written as the data D24 of the second latch unit, and thus the field-effect transistor 465 is in an off state.

In the driving signal output circuit illustrated in FIGS. 15A and 15B, when a pulse of the initialization signal INI_RES1 is input, the signal SCOUT becomes low level and the signal RCOUT becomes high level. On the other hand, when a pulse of the initialization signal INI_RES2 is input, the signal SCOUT becomes high level and the signal RCOUT becomes low level.

In each of the plurality of driving signal output circuits illustrated in FIG. 13, signals input as the set signal SIN_D, the reset signal RIN_D, the control signal CTL1_D, and the control signal CTL2_D are the same as the corresponding signals input to each of the plurality of driving signal output circuits illustrated in FIG. 7B.

The clock signal FCLK1 is input as the control signal CTL3_D of the driving signal output circuit 233_1 illustrated in FIG. 13.

The clock signal GCLK1 is input as the control signal CTL3_D of the driving signal output circuit 233_2.

The signal SCOUT of the driving signal output circuit 233_L−2 is input as the control signal CTL3_D of the driving signal output circuit 233_L.

The clock signal FCLK2 is input as the control signal CTL4_D of the driving signal output circuit 233_1.

The clock signal GCLK2 is input as the control signal CTL4_D of the driving signal output circuit 233_2.

The signal RCOUT of the driving signal output circuit 233_L−2 is input as the control signal CTL4_D of the driving signal output circuit 233_L.

The above is the description of the signal line driver circuit illustrated in FIG. 13.

Next, as an example of a method for driving a signal line driver circuit of this embodiment, an example of a method for driving the signal line driver circuit illustrated in FIG. 7B will be described with reference to a timing chart of FIG. 16. Note that as an example, the duty ratio of each of the clock signals CLK1 to CLK4 is 25%, and the clock signals CLK1 to CLK4 are sequentially delayed by a quarter of one cycle period. The duty ratio of each of the clock signals FCLK1, FCLK2, GCLK1, and GCLK2 is 50%. The clock signal FCLK1 is an inverted signal of the clock signal GCLK1, the clock signal FCLK2 is an inverted signal of the clock signal FCLK1, and the clock signal GCLK2 is an inverted signal of the clock signal GCLK1.

Figure 16:
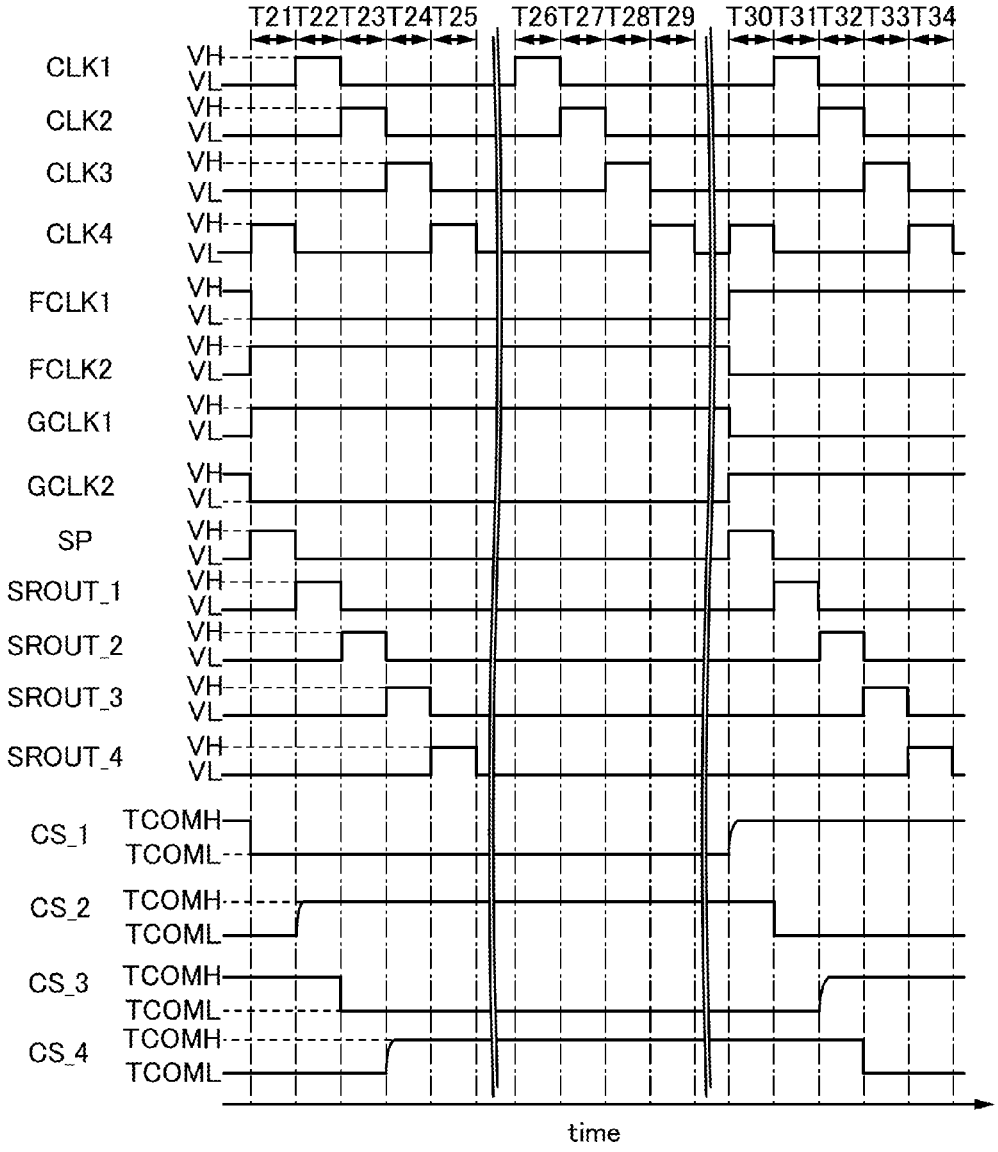
FIG. 16 is a timing chart for illustrating an example of a method for driving a signal line driver circuit.

As shown in FIG. 16, in an example of the method for driving the signal line driver circuit illustrated in FIG. 7B, a pulse of the start pulse signal SP is input to the shift register 230 and the selection circuit 232_1 in a period T21.

In this case, in accordance with the clock signals CLK1 to CLK4, a pulse of the pulse signal SROUT_1 is input to the selection circuit 232_2 in a period T22, a pulse of the pulse signal SROUT_2 is input to the selection circuit 232_3 in a period T23, a pulse of a pulse signal SROUT_3 is input to the selection circuit 232_4 in a period T24, and a pulse of a pulse signal SROUT_4 is input to the selection circuit 232_5 in a period T25. In the periods T21 to T29, the clock signal FCLK1 is at a low level, the clock signal FCLK2 is at a high level, the clock signal GCLK1 is at a high level, and the clock signal GCLK2 is at a low level.

In this case, the selection circuit 232_Q outputs the input pulse of the pulse signal SROUT as a pulse of the pulse signal SELOUT2.

The selection circuit 232_R outputs the input pulse of the pulse signal SROUT as a pulse of the pulse signal SELOUT1.

The pulse of the pulse signal SELOUT1 is input to the driving signal output circuit 233_R as a pulse of the set signal SIN_D. In the driving signal output circuit 233_R to which the pulse of the set signal SIN_D is input, the potential VDD and the potential VSS are written as the data D1 and the data D2, respectively. Accordingly, the potential of the signal DOUT1 becomes the potential TCOMH and the potential of the signal DOUT2 becomes the potential VH. For example, the signal DOUT1 of the driving signal output circuit 233_2 (the common signal CS_2) becomes the potential TCOMH in the period T22. The signal DOUT1 of the driving signal output circuit 233_4 (the common signal CS_4) becomes the potential TCOMH in the period T24.

The pulse of the pulse signal SELOUT2 is input to the driving signal output circuit 233_Q as a pulse of the reset signal RIN_D. In the driving signal output circuit 233_Q to which the pulse of the reset signal RIN_D is input, the potential VSS and the potential VDD are written as the data D1 and the data D2, respectively. Accordingly, the potential of the signal DOUT1 becomes the potential TCOML and the potential of the signal DOUT2 becomes the potential VL. For example, the signal DOUT1 of the driving signal output circuit 233_1 (the common signal CS_1) becomes the potential TCOML in the period T21. The signal DOUT1 of the driving signal output circuit 233_3 (the common signal CS_3) becomes the potential TCOML in the period T23.

In the periods T26 to T29, the control signal CTL1 and the control signal CTL2 that are input to the driving signal output circuit 233_R become high level in accordance with the clock signals CLK1 to CLK4, the clock signals FCLK1 and FCLK2, and the clock signals GCLK1 and GCLK2. Thus, the potential VDD is written to the driving signal output circuit 233_R, which is data rewriting. Note that the operation in the periods T26 to T29 may be repeated. Accordingly, a change in the potential of the data D1 can be small until a pulse of the start pulse signal SP is input to the shift register 230 again.

Further, a pulse of the start pulse signal SP is input to the shift register 230 and the selection circuit 232_1 again in a period T30.

In this case, in accordance with the clock signals CLK1 to CLK4, a pulse of the pulse signal SROUT_1 is input to the selection circuit 232_2 in a period T31, a pulse of the pulse signal SROUT_2 is input to the selection circuit 232_3 in a period T32, and a pulse of the pulse signal SROUT_3 is input to the selection circuit 232_4 in a period T33. In the periods T30 to T34, the clock signal FCLK1 is at a high level, the clock signal FCLK2 is at a low level, the clock signal GCLK1 is at a low level, and the clock signal GCLK2 is at a high level.

In this case, the selection circuit 232_Q outputs the input pulse of the pulse signal SROUT as a pulse of the pulse signal SELOUT1.

The selection circuit 232_R outputs the input pulse of the pulse signal SROUT as a pulse of the pulse signal SELOUT2.

Further, in the driving signal output circuit 233_Q to which the pulse of the set signal SIN_D is input, the potential VDD and the potential VSS are written as the data D1 and the data D2, respectively. Accordingly, the potential of the signal DOUT1 becomes the potential TCOMH and the potential of the signal DOUT2 becomes the potential VH.

In the driving signal output circuit 233_R to which the pulse of the reset signal RIN_D is input, the potential VSS and the potential VDD are written as the data D1 and the data D2, respectively. Accordingly, the potential of the signal DOUT1 becomes the potential TCOML and the potential of the signal DOUT2 becomes the potential VL.

The above is an example of the method for driving the signal line driver circuit illustrated in FIG. 7A.

Figure 17:
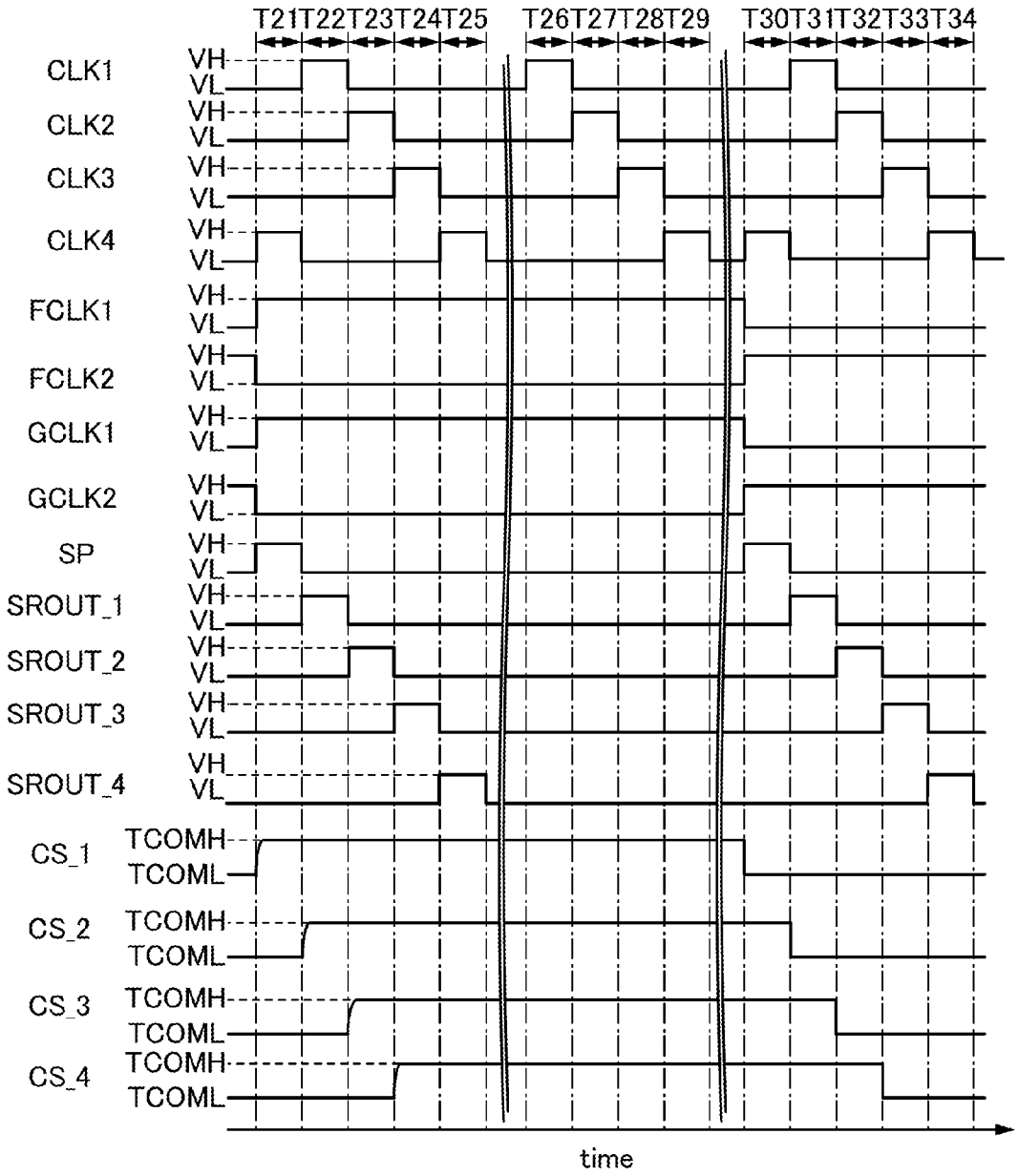
FIG. 17 is a timing chart for illustrating an example of a method for driving a signal line driver circuit.

In an example of the method for driving the signal line driver circuit in this embodiment, as illustrated in FIG. 17, the clock signal FCLK1 and the clock signal GCLK1 may be the same signal and the clock signal FCLK2 and the clock signal GCLK2 may be the same signal, for example. In this case, the signal DOUT1 of the driving signal output circuit_K is a signal which is formed by shifting the signal DOUT1 of the driving signal output circuit_K−1 and the signal DOUT2 of the driving signal output circuit_K is a signal which is formed by shifting the signal DOUT2 of the driving signal output circuit_K−1.

An example of operation of the pixel circuit 210 included in the liquid crystal display device illustrated in FIG. 7A is described with reference to a timing chart of FIG. 18.

Figure 18:
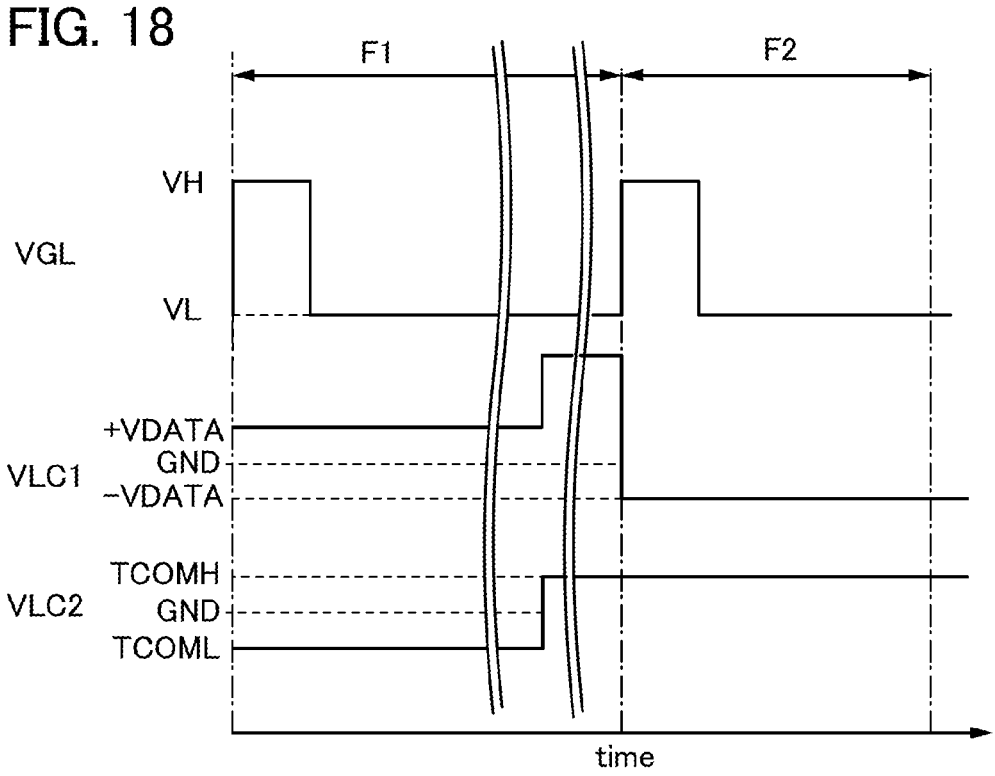
FIG. 18 is a timing chart for illustrating an example of operation of a pixel circuit.

As shown in FIG. 18, when data is written to the pixel circuit 210 in the M-th row and the N-th column in a frame period F1, the potential of the other of the pair of electrodes of the liquid crystal element 212 (also referred to as VLC2) becomes the potential TCOML because of the common signal CS_M input through the common signal line CL_M in the pixel circuit 210. The potential of the other of the pair of electrodes of the liquid crystal element 212 is switched no later than the completion of inputting a pulse of the gate signal GS_M. For example, the potential of the other of the pair of electrodes of the liquid crystal element 212 may be switched while a pulse of the gate signal GS_M is being input.

A pulse of the gate signal GS_M is input through the gate signal line GL_M and in the pixel circuit 210, the field-effect transistor 211 is turned on.

In the pixel circuit 210, at this occasion, the potential of one of the pair of electrodes of the liquid crystal element 212 (also referred to as a potential VLC1) is substantially equal to the potential of the data signal DS input through the data signal line DL_N. Here, the potential VLC1 corresponds to a potential +VDATA. Accordingly, a voltage applied between the pair of electrodes of the liquid crystal element 212 is +VDATA−TCOML. Thus, data is written to the pixel circuit 210.

After that, input of a pulse of the gate signal GS_M is completed, so that the field-effect transistor 211 is turned off. In the pixel circuit 210, electric charges accumulated at one of the pair of electrodes of the liquid crystal element 212 are held. In the pixel circuit 210 to which data has been written, the alignment of liquid crystal included in the liquid crystal layer is controlled in accordance with a voltage applied between the pair of electrodes of the liquid crystal element 212; thus, the pixel circuit 210 is in a display state.

Because of the common signal CS_M input through the common signal line CL_M, the potential of the other of the pair of electrodes of the liquid crystal element 212 (also referred to as VLC2) becomes the potential TCOMH in the pixel circuit 210.

When inverted data is written to the pixel circuit 210 in the M-th row and the N-th column in a frame period F2, a pulse of the gate signal GS_M is input through the gate signal line GL_M, whereby the field-effect transistor 211 is turned on in the pixel circuit 210.

In the pixel circuit 210, the potential VLC1 which is the potential of the liquid crystal element 212 is substantially equal to the potential of the data signal DS input through the data signal line DL_N. Here, the potential VLC1 corresponds to a potential −VDATA. Accordingly, a voltage applied to the pair of electrodes of the liquid crystal element 212 is TCOMH−VDATA.

After that, input of a pulse of the gate signal GS is completed, so that the field-effect transistor 211 is turned off. In the pixel circuit 210, electric charges accumulated at one of the pair of electrodes of the liquid crystal element 212 are held. In the pixel circuit 210 to which data is written, the alignment of liquid crystal included in the liquid crystal layer is controlled in accordance with a voltage applied between the pair of electrodes of the liquid crystal element 212; thus, the pixel circuit 210 is in a display state.

As shown in FIG. 18, in the liquid crystal display device of this embodiment, the polarities of a data signal and a common signal are inverted every frame period, whereby the amplitude of the data signal can be small; accordingly, the amplitude of the gate signal can be small. That is, driving voltage can be lowered, and therefore, power consumption can be reduced.

When data is not necessary to be written to the pixel circuit 210, supply of power to the signal line driver circuits 201 to 203 can be stopped. Accordingly, power consumption of the liquid crystal display device can be reduced. Further, a field-effect transistor with a low off-state current is used as the field-effect transistor 211 of the pixel circuit 210, whereby the same image can be displayed even when supply of power to the signal line driver circuits 201 to 203 is stopped.

The above is the description of the liquid crystal display device of this embodiment.

As described with reference to FIGS. 7A and 7B, FIGS. 8A and 8B, FIGS. 9A and 9B, FIGS. 10A and 10B, FIGS. 11A and 11B, FIGS. 12A and 12B, FIG. 13, FIGS. 14A and 14B, FIGS. 15A and 15B, FIG. 16, FIG. 17, and FIG. 18, one example of the liquid crystal display device of this embodiment can employ a driving method in which by controlling the potential of a common signal line with a signal line driver circuit, the polarity of the potential of one of a pair of electrodes of each of liquid crystal elements and the polarity of the potential of the other electrode are inverted every frame period in pixel circuits on a row-by-row basis.

In an example of the liquid crystal display device of this embodiment, the signal line driver circuit described in Embodiment 1 is used as a signal line driver circuit for controlling the potential of a common signal line. Accordingly, first data of a latch unit can be rewritten even in a period during which a pulse of a start pulse signal is not input to a shift register. Thus, for example, a change in potential, which is first data, due to leakage current of a field-effect transistor in the driving signal output circuit can be prevented. Therefore, a malfunction of the liquid crystal display device can be suppressed.

Embodiment 3

In this embodiment, an example of a structure of the liquid crystal display device described in Embodiment 2 will be described with reference to FIG. 19.

Figure 19:
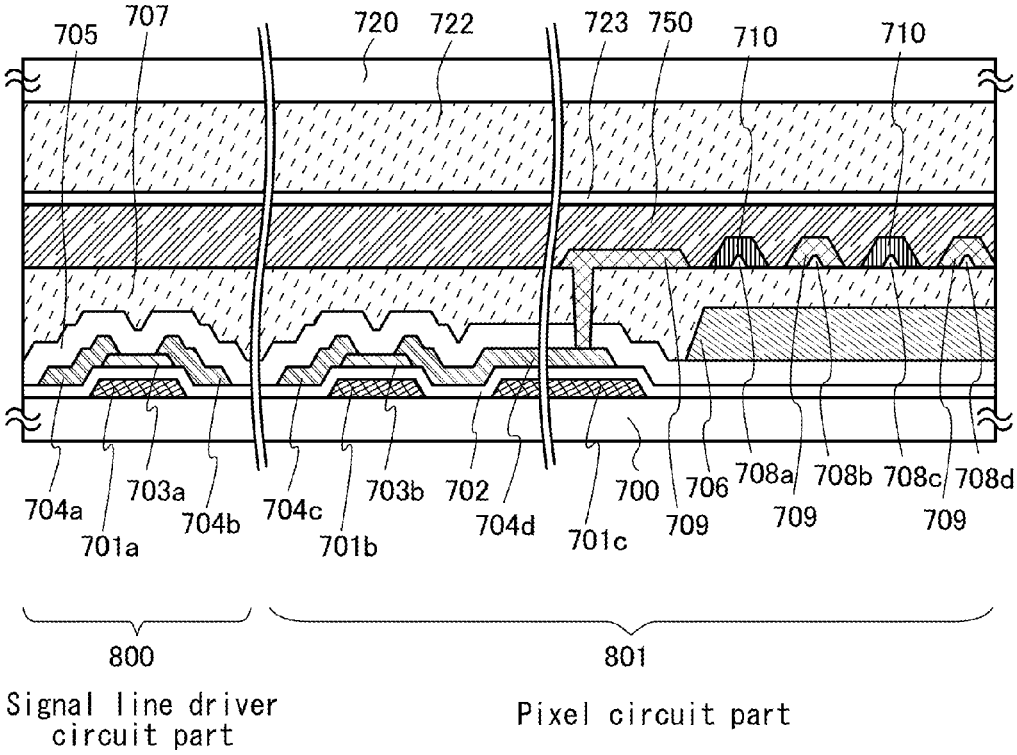
FIG. 19 is a schematic cross-sectional view illustrating a structural example of a liquid crystal display device.

An example of the liquid crystal display device of this embodiment is a horizontal-electric-field mode liquid crystal display device and includes conductive layers 701*a* to 701*c*, an insulating layer 702, semiconductor layers 703*a* and 703*b*, conductive layers 704*a* to 704*d*, an insulating layer 705, a coloring layer 706, an insulating layer 707, structure bodies 708*a* to 708*d*, a conductive layer 709, a conductive layer 710, an insulating layer 722, an insulating layer 723, and a liquid crystal layer 750, as illustrated in FIG. 19.

The conductive layers 701*a* to 701*c* are provided over a plane surface of a substrate 700.

The conductive layer 701*a* is provided in a signal line driver circuit part 800. The conductive layer 701*a* has a function as a gate of a field-effect transistor in a signal line driver circuit.

The conductive layer 701*b* is provided in a pixel circuit part 801. The conductive layer 701*b* has a function as a gate of a field-effect transistor in a pixel circuit.

The conductive layer 701*c* is provided in the pixel circuit part 801. The conductive layer 701*c* has a function as the other of a pair of electrodes of a capacitor in the pixel circuit.

The insulating layer 702 is provided over the conductive layers 701*a* to 701*c*. The insulating layer 702 has functions as a gate insulating layer in the field-effect transistor of the signal line driver circuit, a gate insulating layer in the field-effect transistor of the pixel circuit, and a dielectric layer in the capacitor of the pixel circuit.

The semiconductor layer 703*a* overlaps the conductive layer 701*a* with the insulating layer 702 laid therebetween. The semiconductor layer 703*a* has a function as a layer where a channel is formed (also referred to as a channel formation layer) in the field-effect transistor of the signal line driver circuit.

The semiconductor layer 703*b* overlaps the conductive layer 701*b* with the insulating layer 702 laid therebetween. The semiconductor layer 703*b* has a function as a channel formation layer included in the field-effect transistor of the pixel circuit.

The conductive layer 704*a* is electrically connected to the semiconductor layer 703*a*. The conductive layer 704*a* has a function as one of a source and a drain of the field-effect transistor of the signal line driver circuit.

The conductive layer 704*b* is electrically connected to the semiconductor layer 703*a*. The conductive layer 704*b* has a function as the other of the source and the drain of the field-effect transistor of the signal line driver circuit.

The conductive layer 704*c* is electrically connected to the semiconductor layer 703*b*. The conductive layer 704*c* has a function as one of a source and a drain of the field-effect transistor of the pixel circuit.

The conductive layer 704*d* is electrically connected to the semiconductor layer 703*b*. The conductive layer 704*d* overlaps the conductive layer 701*c* with the insulating layer 702 laid therebetween. The conductive layer 704*d* has a function as the other of the source and the drain of the field-effect transistor of the pixel circuit and one of the pair of electrodes of the capacitor of the pixel circuit.

The insulating layer 705 is provided over the semiconductor layers 703*a* and 703*b* and the conductive layers 704*a* to 704*d*. The insulating layer 705 has a function as an insulating layer for protecting the field-effect transistors (also referred to as a protective insulating layer).

The coloring layer 706 is provided over the insulating layer 705. The coloring layer 706 has a function as a color filter.

The insulating layer 707 is provided over the insulating layer 705 with the coloring layer 706 laid therebetween. The insulating layer 707 has a function as a planarization layer.

The structure bodies 708*a* to 708*d* are provided over the insulating layer 707. By providing the structure bodies 708*a* to 708*d*, the alignment of liquid crystal in a liquid crystal element can be efficiently controlled.

The conductive layer 709 is provided over the insulating layer 707 and electrically connected to the conductive layer 704*d* through an opening penetrating the insulating layer 705 and the insulating layer 707. The conductive layer 709 has a comb-shaped portion. A tooth of the comb-shaped portion of the conductive layer 709 is provided over the insulating layer 707 with the structure body 708*b* or the structure body 708*d* laid therebetween. The conductive layer 709 has a function as one of the pair of electrodes of the liquid crystal element in the pixel circuit.

The conductive layer 710 is provided over the insulating layer 707. The conductive layer 710 has a comb-shaped portion. A tooth of the comb-shaped portion of the conductive layer 710 and the tooth of the comb-shaped portion of the conductive layer 709 are alternately provided in parallel. The tooth of the comb-shaped portion of the conductive layer 710 is provided over the insulating layer 707 with the structure body 708*a* or 708*c* laid therebetween. The conductive layer 710 has a function as the other of the pair of electrodes of the liquid crystal element in the pixel circuit.

The conductive layers 709 and 710 overlap the coloring layer 706 with the insulating layer 707 laid therebetween.

The insulating layer 722 is provided on a plane surface of a substrate 720. The insulating layer 722 has a function as a planarization layer.

The insulating layer 723 is provided on a plane surface of the insulating layer 722. The insulating layer 723 has a function as a protective insulating layer.

The liquid crystal layer 750 is provided over the conductive layers 709 and 710.

Note that the field-effect transistor is a channel-etched field-effect transistor in FIG. 19, but it is not limited thereto; for example, the field-effect transistor may be a channel-stop field-effect transistor or a top-gate field-effect transistor.

In addition, components of the liquid crystal display device illustrated in FIG. 19 are described.

A glass substrate or a plastic substrate, for example, can be used as each of the substrates 700 and 720.

A layer formed using a metal material such as molybdenum, titanium, chromium, tantalum, magnesium, silver, tungsten, aluminum, copper, neodymium, or scandium can be used for the conductive layers 701*a* to 701*c*. The conductive layers 701*a* to 701*c* can also be formed by stacking layers of materials which can be applied to the conductive layers 701*a* to 701*c*.

The insulating layer 702 can be, for example, a layer including a material such as silicon oxide, silicon nitride, silicon oxynitride, silicon nitride oxide, aluminum oxide, aluminum nitride, aluminum oxynitride, aluminum nitride oxide, or hafnium oxide. The insulating layer 702 can also be formed by stacking layers of materials which can be applied to the insulating layer 702.

As each of the semiconductor layers 703*a* and 703*b*, for example, it is possible to use an oxide semiconductor layer or a semiconductor layer containing a semiconductor which belongs to Group 14 (e.g., silicon).

For example, a semiconductor layer including an oxide semiconductor can be single crystal, polycrystalline (also referred to as polycrystal), or amorphous, for example.

As an oxide semiconductor that can be applied to the semiconductor layer 703*a* and the semiconductor layer 703*b*, metal oxide including zinc and one or both of indium and gallium, metal oxide including another metal element instead of part or all of gallium in the given metal oxide, or the like can be given.

For example, In-based metal oxide, Zn-based metal oxide, In—Zn-based metal oxide, In—Ga—Zn-based metal oxide, or the like can be used as the metal oxide. Alternatively, metal oxide including another metal element instead of part or all of Ga (gallium) in the In—Ga—Zn-based metal oxide may be used.

As another metal element, a metal element that can be bound to oxygen atoms more than gallium can be used; for example, one or more of titanium, zirconium, hafnium, germanium, and tin, or the like can be used. Further, as another metal element, one or more of lanthanum, cerium, praseodymium, neodymium, samarium, europium, gadolinium, terbium, dysprosium, holmium, erbium, thulium, ytterbium, and lutetium, or the like can be also used. The above metal elements each have a function as a stabilizer. Note that the amount of the metal element is the amount at which the metal oxide can serve as a semiconductor. A metal element that can be bound to oxygen atoms more than gallium is used and oxygen is supplied to the metal oxide, whereby oxygen vacancies in the metal oxide can be reduced.

For example, when tin is used instead of all Ga (gallium) contained in the In—Ga—Zn-based metal oxide, In—Sn—Zn-based metal oxide is obtained. When titanium is used instead of part of Ga (gallium) contained in the In—Ga—Zn-based metal oxide, In—Ti—Ga—Zn-based metal oxide is obtained.

The oxide semiconductor layer may be an oxide semiconductor layer including CAAC-OS (c-axis aligned crystalline oxide semiconductor).

The crystal amorphous mixed phase structure includes crystal parts in an amorphous phase and is not a completely single crystal structure or a completely amorphous structure. In each of the crystal parts included in the CAAC-OS, a c-axis is aligned in a direction parallel to a normal vector of a surface where the CAAC-OS is formed or a normal vector of a surface of the CAAC-OS, triangular or hexagonal atomic arrangement which is seen from the direction perpendicular to the a-b plane is formed, and metal atoms are arranged in a layered manner or metal atoms and oxygen atoms are arranged in a layered manner when seen from the direction perpendicular to the c-axis. In this specification, a simple term "perpendicular" includes a range from 85° to 95°. In addition, a simple term "parallel" includes a range from −5° to 5°.

In a field-effect transistor that uses an oxide semiconductor layer including the CAAC-OS as a channel formation layer, a change in electric characteristics due to irradiation with visible light or ultraviolet light can be reduced; thus, the transistor has high reliability.

In the case where an oxide semiconductor layer is used as the semiconductor layers 703*a* and 703*b*, for example, dehydration or dehydrogenation is performed; thus, impurities such as hydrogen, water, a hydroxyl group, and a hydride (also referred to as hydrogen compound) are removed from the oxide semiconductor layer, and in addition, oxygen is supplied to the oxide semiconductor layer. For example, a layer containing oxygen is used as the layer in contact with the oxide semiconductor layer, and heat treatment is performed; thus, the oxide semiconductor layer can be highly purified.

For example, heat treatment is performed at a temperature higher than or equal to 350° C. and lower than the strain point of the substrate, preferably higher than or equal to 350° C. and lower than or equal to 450° C. Heat treatment may be further performed in a later step. As a heat treatment apparatus for the heat treatment, for example, an electric furnace or an apparatus for heating an object by heat conduction or heat radiation from a heater such as a resistance heater can be used; for example, a rapid thermal annealing (RTA) apparatus such as a gas rapid thermal annealing (GRTA) apparatus or a lamp rapid thermal annealing (LRTA) apparatus can be used.

Further, after the heat treatment, a high-purity oxygen gas, a high-purity $N_2O$ gas, or ultra-dry air (having a dew point −40° C. or lower, preferably −60° C. or lower) may be introduced in the furnace where the heat treatment has been performed while the heating temperature is being maintained or being decreased. It is preferable that the oxygen gas or the $N_2O$ gas do not contain water, hydrogen, and the like. The purity of the oxygen gas or the $N_2O$ gas which is introduced into the heat treatment apparatus is preferably equal to or more than 6N, more preferably equal to or more than 7N (i.e., the impurity concentration of the oxygen gas or the $N_2O$ gas is preferably equal to or lower than 1 ppm, more preferably equal to or lower than 0.1 ppm). By the action of the oxygen gas or the $N_2O$ gas, oxygen is supplied to the oxide semiconductor layer, and defects due to oxygen vacancy in the oxide semiconductor layer can be reduced. Note that the introduction of a high-purity oxygen gas, a high-purity $N_2O$ gas, or ultra-dry air may be performed at the time of the above heat treatment.

With the use of the highly purified oxide semiconductor layer for the field-effect transistor, the carrier density of the oxide semiconductor layer can be lower than $1\times10^{14}/cm^3$, preferably lower than $1\times10^{12}/cm^3$, further preferably lower than $1\times10^{11}/cm^3$. The off-state current of the field-effect transistor per micrometer of channel width can be 10 aA ($1\times10^{-17}$ A) or less, 1 aA ($1\times10^{-18}$ A) or less, 10 zA ($1\times10^{-20}$ A) or less, further 1 zA ($1\times10^{-21}$ A) or less, and furthermore 100 yA ($1\times10^{-22}$ A) or less. It is preferable that the off-state current of the field-effect transistor be as low as possible; the lower limit of the off-state current of the field-effect transistor in this embodiment is estimated to be about $10^{-30}$ A/μm.

A layer formed using a metal material such as molybdenum, titanium, chromium, tantalum, magnesium, silver, tungsten, aluminum, copper, neodymium, scandium, or ruthenium can be used for the conductive layers 704*a* to 704*d*. The conductive layers 704*a* to 704*d* can also be formed by stacking layers whose materials can be applied to the conductive layers 704*a* to 704*d*.

The insulating layer 705 can be an oxide insulating layer containing silicon oxide, aluminum oxide, hafnium oxide, or the like.

The coloring layer 706 can be a layer which includes dye or pigment, for example, and which transmits light with the wavelength range of red, light with the wavelength range of green, and light with the wavelength range of blue. The coloring layer 706 can be a layer which includes dye or pigment, for example, and which transmits light with the wavelength range of cyan, magenta, or yellow.

Each of the insulating layers 707 and 722 can be a layer of an organic insulating material or an inorganic insulating material, for example.

The structure bodies 708*a* to 708*d* can be formed using an organic insulating material or an inorganic insulating material, for example.

The conductive layer 709 can be a layer of metal oxide which transmits light, for example. For example, metal oxide including indium, or the like can be used. The conductive layer 709 can also be formed by stacking layers whose materials can be applied to the conductive layer 709.

The conductive layer 710 can be a layer of metal oxide through which light passes, for example. For example, metal oxide including indium or the like can be used. The conductive layer 710 can also be formed by stacking layers whose materials can be applied to the conductive layer 710.

The insulating layer 723 can be, for example, a layer including a material such as silicon oxide, silicon nitride, silicon oxynitride, silicon nitride oxide, aluminum oxide, aluminum nitride, aluminum oxynitride, aluminum nitride oxide, or hafnium oxide.

The liquid crystal layer 750 can be a layer including liquid crystal exhibiting a blue phase, for example.

A layer including liquid crystal exhibiting a blue phase contains a liquid crystal composition including liquid crystal exhibiting a blue phase, a chiral agent, a liquid-crystalline monomer, a non-liquid-crystalline monomer, and a polymerization initiator. The liquid crystal exhibiting a blue phase has a short response time, and has optical isotropy that contributes to the exclusion of the alignment process and reduction of viewing angle dependence. Therefore, with the liquid crystal exhibiting a blue phase, the operation speed can be increased.

The liquid crystal composition can be a composition shown in Table 1, for example. As mixture ratios between the liquid crystal materials, the mixture ratio between the liquid crystal and the chiral agent; the mixture ratio between the liquid crystal and the chiral agent, the liquid-crystalline monomer, and the non-liquid-crystalline monomer; and the mixture ratio of the liquid crystal, the chiral agent, the liquid-crystalline monomer, and the non-liquid-crystalline monomer to the polymerization initiator are shown.

TABLE 1

| Composition | Material | Mixture Ratio (wt %) | | | |
|---|---|---|---|---|---|
| Liquid Crystal | MDA-00-3506 (produced by Merck Ltd.) | 30 | 90.5 | 92 | 99.8 |
| | NEDO LC-C | 20 | | | |
| | CPP-3FF | 20 | | | |
| | PEP-5CNF | 15 | | | |
| | PEP-5FCNF | 15 | | | |
| Chiral Agent | ISO-(6OBA)$_2$ | | 9.5 | | |
| Liquid-crystalline Monomer | RM257-O6 | | | 4 | |
| Non-liquid-crystalline Monomer | DMeAc | | | 4 | |
| Polymerization Initiator | DMPAP | | | | 0.2 |

Note that CPP-3FF is an abbreviation of 4-(trans-4-n-propylcyclohexyl)-3',4'-difluoro-1,1'-biphenyl. PEP-5 CNF is an abbreviation of 4-n-pentylbenzoic acid 4-cyano-3-fluorophenyl. PEP-5FCNF is an abbreviation of 4-n-pentylbenzoic acid 4-cyano-3,5-difluorophenyl ester. ISO-(6OBA)$_2$ is an abbreviation of 1,4:3,6-dianhydro-2,5-bis[4-(n-hexyl-1-oxy)benzoic acid]sorbitol. RM257-06 is an abbreviation of 1,4-bis-[4-(6-acryloyloxy-n-hexyl-1-oxy)benzoyloxy]-2-methylbenzene. DMeAc is an abbreviation of n-dodecyl methacrylate. DMPAP is an abbreviation of 2,2-dimethoxy-2-phenylacetophenone.

A liquid crystal composition can also be a composition shown in Table 2, for example.

TABLE 2

| Composition | Material | Mixture Ratio (wt %) | | | |
|---|---|---|---|---|---|
| Liquid Crystal | MDA-00-3506 (produced by Merck Ltd.) | 50 | 92.5 | 92 | 99.7 |
| | CPEP-3FCNF | 20 | | | |
| | PEP-3FCNF | 30 | | | |
| Chiral Agent | R-DOL-Pn | | 7.5 | | |
| Liquid-crystalline Monomer | RM257-O6 | | | 4 | |
| Non-liquid-crystalline Monomer | DMeAc | | | 4 | |
| Polymerization Initiator | DMPAP | | | | 0.3 |

Note that CPEP-5FCNF is an abbreviation of 4-(trans-4-n-pentylcyclohexyl)benzoic acid 4-cyano-3,5-difluorophenyl ester. Further, PEP-3FCNF is an abbreviation of 4-cyano-3,5-difluorophenyl 4-n-propylbenzoate. R-DOL-Pn is an abbreviation of (4R,5R)-2,2'-dimethyl-α-α-α'-α'-tetra(9-phenanthryl)-1,3-dioxolane-4,5-dimethanol.

A liquid crystal composition can also be a composition shown in Table 3, for example.

TABLE 3

| Composition | Material | Mixture Ratio (wt %) | | | |
|---|---|---|---|---|---|
| Liquid Crystal | MDA-00-3506 (produced by Merck Ltd.) | 50 | 92.5 | 92 | 99.7 |
| | PPEP-5FCNF | 20 | | | |
| | PEP-3FCNF | 30 | | | |
| Chiral Agent | R-DOL-Pn | | 7.5 | | |
| Liquid-crystalline Monomer | RM257-O6 | | | 4 | |
| Non-liquid-crystalline Monomer | Dac | | | 4 | |
| Polymerization Initiator | DMPAP | | | | 0.3 |

Note that PPEP-5FCNF is an abbreviation of 4-(4-n-pentylphenyl)benzoic acid 4-cyano-3,5-difluorophenyl.

The above is the description of an example of the structure of the liquid crystal display device illustrated in FIG. 19.

In an example of the liquid crystal display device of this embodiment, a signal line driver circuit is provided over the same substrate as a pixel circuit, as described with reference to FIG. 19. Thus, the number of wirings for connecting the pixel circuit and the signal line driver circuit can be reduced.

In an example of the liquid crystal display device of this embodiment, a liquid crystal element is formed using liquid crystal exhibiting a blue phase, which results in higher operation speed of the liquid crystal display device.

Embodiment 4

In this embodiment, examples of an electronic device that is provided with a panel using the liquid crystal display device described in Embodiments 2 and 3 will be described with reference to FIGS. 20A to 20D.

FIGS. 20A to 20D are schematic diagrams of structural examples of the electronic device of this embodiment.

Figure 20A:
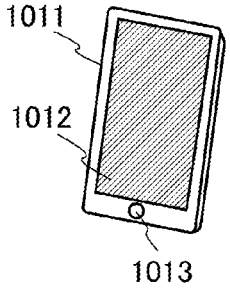
FIGS. 20A to 20D each illustrate an example of an electronic device.

An electronic device illustrated in FIG. 20A is an example of a personal digital assistant.

The digital assistant illustrated in FIG. 20A has a housing 1011 and a panel 1012 and a button 1013 that are provided for the housing 1011.

Note that the housing 1011 may be provided with a connection terminal for connecting the electronic device illustrated in FIG. 20A to an external device and/or a button used to operate the electronic device illustrated in FIG. 20A.

The panel 1012 has a function as a display panel.

The panel 1012 can be the liquid crystal display device in Embodiments 2 and 3.

The panel 1012 may have a function as a touch panel. In this case, data may be input in such a manner that an image of a keyboard is displayed on the panel 1012 and then touched with a finger.

The button 1013 is provided for the housing 1011. For example, when a power button is provided as the button 1013, the electronic device can be turned on or off by pressing the button 1013.

The electronic device illustrated in FIG. 20A has functions as one or more of a telephone set, an e-book reader, a personal computer, and a game machine, for example.

Figure 20B:
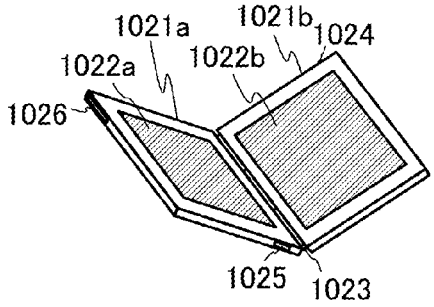

An electronic device illustrated in FIG. 20B is an example of a folding digital assistant.

The electronic device illustrated in FIG. 20B has a housing 1021*a*, a housing 1021*b*, a panel 1022*a* provided for the housing 1021*a*, a panel 1022*b* provided for the housing 1021*b*, a hinge 1023, a button 1024, a connection terminal 1025, and a storage media inserting portion 1026.

The housing 1021*a* and the housing 1021*b* are connected by the hinge 1023.

The panels 1022*a* and 1022*b* each have a function as a display panel. For example, the panels 1022*a* and 1022*b* may display different images or one image. The electronic device illustrated in FIG. 20B may be operated in a state where the panels 1022*a* and 1022*b* are arranged vertically or horizontally.

The panels 1022*a* and 1022*b* can be the liquid crystal display device in Embodiments 2 and 3.

Further, one or both of the panels 1022*a* and 1022*b* may have a function as a touch panel. In this case, data may be input in such a manner that an image of a keyboard is displayed on one or both of the panels 1022*a* and 1022*b* and then touched with a finger.

Since the electronic device illustrated in FIG. 20B has the hinge 1023, the housing 1021*a* or the housing 1021*b* can be moved to overlap the housing 1021*a* with the housing 1021*b*, for example; that is, the electronic device can fold.

The button 1024 is provided for the housing 1021*b*. Note that the housing 1021*a* may also be provided with the button 1024. For example, when the button 1024 which has a function as a power button is provided and pushed, whether power is supplied to circuits in the electronic device can be controlled.

The connection terminal 1025 is provided for the housing 1021*a*. Note that the housing 1021*b* may be provided with the connection terminal 1025. Further alternatively, a plurality of connection terminals 1025 may be provided on one or both of the housings 1021*a* and the housing 1021*b*. The connection terminal 1025 is a terminal for connecting the electronic device illustrated in FIG. 20B to another device.

The storage media inserting portion 1026 is provided for the housing 1021*a*. Note that the storage medium insertion portion 1026 may be provided on the housing 1021*b*. Alternatively, the plurality of recording medium insertion portions 1026 may be provided for one or both of the housings 1021*a* and 1021*b*. For example, a card-type recording medium is inserted into the storage media inserting portion so that data can be read to the electronic device from the card-type recording medium or data stored in the electronic device can be written to the card-type recording medium.

The electronic device illustrated in FIG. 20B has functions as one or more of a telephone set, an e-book reader, a personal computer, and a game machine, for example.

Figure 20C:
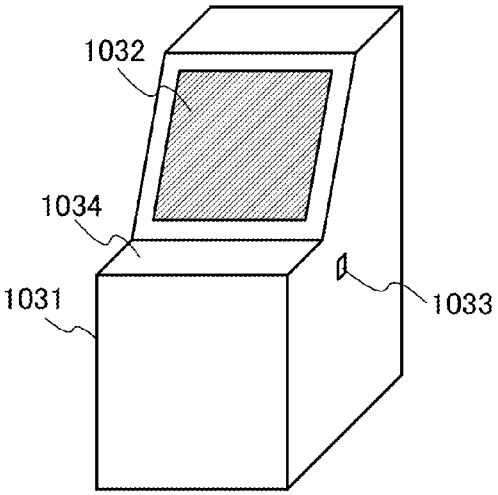

An electronic device illustrated in FIG. 20C is an example of a stationary digital assistant. The stationary digital assistant illustrated in FIG. 20C has a housing 1031, and a panel 1032 and a button 1033 that are provided for the housing 1031.

The panel 1032 has functions as a display panel and a touch panel.

Note that the panel 1032 can be provided for a deck portion 1034 of the housing 1031.

The panel 1032 can be the liquid crystal display device in Embodiments 2 and 3.

The housing 1031 may be provided with one or more of a ticket slot from which a ticket or the like is dispensed, a coin slot, and a bill slot.

The button 1033 is provided for the housing 1031. For example, when the button 1033 which has a function as a power button is provided and pushed, whether power is supplied to circuits in the electronic device can be controlled.

The electronic device illustrated in FIG. 20C has, for example, a function as an automated teller machine, an information communication terminal for ordering a ticket or the like (also referred to as a multi-media station), or a game machine.

Figure 20D:
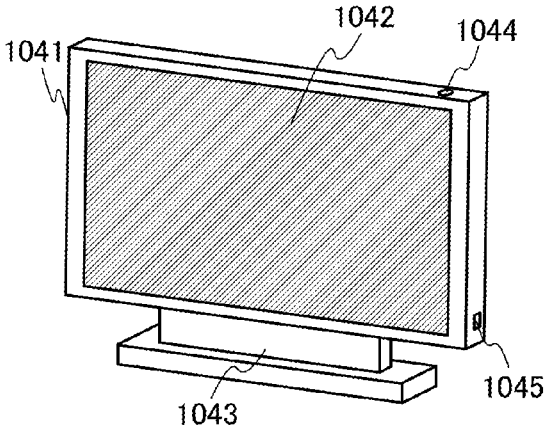

FIG. 20D illustrates an example of a stationary digital assistant. The electronic device illustrated in FIG. 20D has a housing 1041, a panel 1042 provided for the housing 1041, a button 1044, and a connection terminal 1045, and a support base 1043 supporting the housing 1041.

Note that a connection terminal for connecting the housing 1041 to an external device and/or a button used to operate the electronic device illustrated in FIG. 20D may be provided.

The panel 1042 has a function as a display panel. The panel 1042 may have a function as a touch panel.

The panel 1042 can be the liquid crystal display device in Embodiments 2 and 3.

The button 1044 is provided for the housing 1041. For example, when the button 1044 which has a function as a power button is provided and pushed, whether power is supplied to circuits in the electronic device can be controlled.

The connection terminal 1045 is provided for the housing 1041. The connection terminal 1045 is a terminal for connecting the electronic device illustrated in FIG. 20D to another device. For example, connecting the electronic device illustrated in FIG. 20D and a personal computer with the connection terminal 1045 enables the panel 1042 to display an image corresponding to a data signal input from the personal computer. For example, when the panel 1042 of the electronic device illustrated in FIG. 20D is larger than a panel of an electronic device connected thereto, a displayed image of the electronic device can be enlarged, in which case a plurality of viewers can recognize the image at the same time with ease.

The electronic device illustrated in FIG. 20D has, for example, a function as a digital photo frame, an output monitor, a personal computer, or a television set.

The above is the description of examples of the electronic device of this embodiment.

As described with reference to FIGS. 20A to 20D, in an example of the electronic device of this embodiment, provision of a panel having the liquid crystal display device of the above embodiments enhances operation speed of the panel. Accordingly, for example, an electronic device that can operate (e.g., reproduce a moving image) at high speed can be provided.

EXPLANATION OF REFERENCE

101: shift register; 112: selection circuit; 113: driving signal output circuit; 121: latch unit; 122: buffer unit; 123: buffer unit; 124: switch unit; 131*a*: latch unit; 131*b*: latch unit; 132*a*: buffer unit; 132*b*: buffer unit; 133*a* to 133*d*: switch unit; 134: buffer unit; 201: signal line driver circuit; 202: signal line driver circuit; 203: signal line driver circuit; 204: signal line driver circuit; 210: pixel circuit; 211: field-effect transistor; 212: liquid crystal element; 213: capacitor; 230: shift register; 231: pulse output circuit; 232: selection circuit; 233: driving signal output circuit; 311 to 319: field-effect transistor; 321: capacitor; 322: capacitor; 331 to 336: field-effect transistor; 351 to 364: field-effect transistor; 371: capacitor; 372: capacitor; 431 to 444: field-effect transistor; 451: capacitor; 452: capacitor; 461 to 474: field-effect transistor; 481: capacitor; 482: capacitor; 491: field-effect transistor; 492: field-effect transistor; 700: substrate; 701*a*: conductive layer; 701*b*: conductive layer; 701*c*: conductive layer; 702: insulating layer; 703*a*: semiconductor layer; 703*b*: semiconductor layer; 704*a* to 704*d*: conductive layer; 705: insulating layer; 706: coloring layer; 707: insulating layer; 708*a* to 708*d*: structure body; 709: conductive layer; 710: conductive layer; 720: substrate; 722: insulating layer; 723: insulating layer; 750: liquid crystal layer; 800: signal line driver circuit part; 801: pixel circuit part; 1011: housing; 1012: panel; 1013: button; 1021*a*: housing; 1021*b*: housing; 1022*a*: panel; 1022*b*: panel; 1023: hinge; 1024: button; 1025: connection terminal; 1026: storage media inserting portion; 1031: housing; 1032: panel; 1033: button; 1034: deck portion; 1041: housing; 1042: panel; 1043: support base; 1044: button; 1045: connection terminal This application is based on Japanese Patent Application serial no. 2011-247262 filed with Japan Patent Office on Nov. 11, 2011, the entire contents of which are hereby incorporated by reference.

The invention claimed is:

1. A driver circuit comprising:

a shift register;

a selection circuit having a function of determining that a pulse signal input from the shift register is output as a first pulse signal or a second pulse signal, in accordance with a first clock signal and a second clock signal; and a driving signal output circuit having functions of generating and outputting a driving signal for controlling a potential of a signal line in accordance with the first and second pulse signals input from the selection circuit and a first control signal and a second control signal, wherein the driving signal output circuit comprises:

a latch unit configured to write and store first data and second data in accordance with the first and second pulse signals;

a buffer unit configured to set a potential of the driving signal in accordance with the first data and the second data and output the driving signal; and a switch unit configured to control pull-up of the latch unit output of only the first data by being turned on or off in accordance with the first control signal and the second control signal so as to suppress a change in a potential of the first data.

2. The driver circuit according to claim 1, wherein the driving signal output circuit comprises a first transistor comprising an oxide semiconductor layer in a channel formation layer.

3. A liquid crystal display device comprising the driver circuit according to claim 1, further comprising:

a data signal line;

a gate signal line;

a common signal line whose potential is controlled by the driving signal output from the driver circuit; and a pixel comprising a pixel circuit and a liquid crystal element, wherein the pixel circuit comprises a second transistor one of whose source and drain is electrically connected to the data signal line and whose gate is electrically connected to the gate signal line, and wherein the liquid crystal element comprises a pair of electrodes, one of the pair of electrodes is electrically connected to the other of the source and the drain of the second transistor and the other of the pair of electrodes is electrically connected to the common signal line.

4. The liquid crystal display device according to claim 3, wherein the second transistor comprises an oxide semiconductor layer in a channel formation layer.

5. The liquid crystal display device according to claim 3, further comprising a coloring layer functioning as a color filter.

6. The liquid crystal display device according to claim 3, wherein a liquid crystal material in the liquid crystal element exhibits a blue phase.

7. The driver circuit according to claim 1, wherein the switch controls pull-up of the latch unit output of the first data in a period that the first pulse signal and the second pulse signal are not input to the driving signal output circuit.

8. A driver circuit comprising:

a shift register;

a selection circuit having a function of determining that a pulse signal input from the shift register is output as a first pulse signal or a second pulse signal, in accordance with a first clock signal and a second clock signal; and a driving signal output circuit having functions of generating and outputting a driving signal for controlling a potential of a signal line in accordance with the first and second pulse signals input from the selection circuit and a first control signal, a second control signal, a third control signal, a fourth control signal, and a fifth control signal, wherein the driving signal output circuit comprises:

a first latch unit configured to write and store first data and second data in accordance with the first and second pulse signals;

a second latch unit configured to write and store third data and fourth data in accordance with the first and second pulse signals;

a first buffer unit configured to set a potential of the first signal in accordance with the first data and the second data and output the first signal;

a second buffer unit configured to set a potential of the second signal in accordance with the third data and the fourth data and output the second signal;

a first switch unit configured to control pull-up of the first latch unit output of only the first data by being turned on or off in accordance with the first control signal and the second control signal so as to suppress a change in a potential of the first data;

a second switch unit configured to control pull-up of the second latch unit output of the third data by being turned on or off in accordance with the first control signal and the third control signal so as to suppress a change in a potential of the third data;

a third switch unit to which the second signal is input as the fourth control signal and that is configured to control pull-up of the first latch unit output of the second data by being turned on or off in accordance with the fourth control signal so as to suppress a change in a potential of the second data;

a fourth switch unit to which the first signal is input as the fifth control signal and that is configured to control pull-up of the second latch unit output of the fourth data by being turned on or off in accordance with the fifth control signal so as to suppress a change in a potential of the fourth data; and a third buffer unit configured to set a potential of the driving signal in accordance with the first signal and the second signal and output the driving signal.

9. The driver circuit according to claim 8, wherein the driving signal output circuit comprises a first transistor, comprising an oxide semiconductor layer in a channel formation layer.

10. A liquid crystal display device comprising the driver circuit according to claim 8, further comprising:

a data signal line;

a gate signal line;

a common signal line whose potential is controlled by the driving signal output from the driver circuit; and a pixel comprising a pixel circuit and a liquid crystal element, wherein the pixel circuit comprises a second transistor one of whose source and drain is electrically connected to the data signal line and whose gate is electrically connected to the gate signal line, and wherein the liquid crystal element comprises a pair of electrodes, one of the pair of electrodes is electrically connected to the other of the source and the drain of the second transistor and the other of the pair of electrodes is electrically connected to the common signal line.

11. The liquid crystal display device according to claim 10, wherein the second transistor comprises an oxide semiconductor layer in a channel formation layer.

12. The liquid crystal display device according to claim 10, further comprising a coloring layer functioning as a color filter.

13. The liquid crystal display device according to claim 10, wherein a liquid crystal material in the liquid crystal element exhibits a blue phase.

14. The driver circuit according to claim 8, wherein the first switch controls pull-up of the first latch unit output of the first data in a period that the first pulse signal and the second pulse signal are not input to the driving signal output circuit.

* * * * *

UNITED STATES PATENT AND TRADEMARK OFFICE

CERTIFICATE OF CORRECTION

PATENT NO. : 9,053,675 B2
APPLICATION NO. : 13/667222
DATED : June 9, 2015
INVENTOR(S) : Miyake It is certified that error appears in the above-identified patent and that said Letters Patent is hereby corrected as shown below:

In the specification

Column 4, line 48, replace "SN" with --SIN--;

Column 4, line 48, replace "RN" with --RIN--;

Column 4, line 55, replace "SN" with --SIN--;

Column 4, line 66, replace "SN" with --SIN--;

Column 4, line 66, replace "RN" with --RIN--;

Column 5, line 2, replace "SN" with --SIN--;

Column 5, line 3, replace "RN" with --RIN--;

Column 5, line 32, replace "SN" with --SIN--;

Column 5, line 33, replace "RN" with --RIN--;

Column 5, line 60, replace "SN" with --SIN--;

Column 5, line 60, replace "RN" with --RIN--;

Column 5, line 66, replace "SN" with --SIN--;

Column 6, line 10, replace "SN" with --SIN--;

Column 6, line 10, replace "RN" with --RIN--;

Column 6, line 14, replace "SN" with --SIN--;

Column 6, line 14, replace "RN" with --RIN--;

Column 6, line 15, replace "SN" with --SIN--;

Column 6, line 15, replace "RN" with --RIN--;

Column 6, line 19, replace "SN" with --SIN--;

Column 6, line 19, replace "RN" with --RIN--;

Column 7, line 6, replace "SN" with --SIN--;

Signed and Sealed this
Twenty-third Day of February, 2016

Michelle K. Lee

Michelle K. Lee
*Director of the United States Patent and Trademark Office*

In the specification

Column 7, line 11, replace “SN” with --SIN--;

Column 7, line 12, replace “RN” with --RIN--; and

Column 29, line 29, replace “$10^{-3o}$” with --$10^{-30}$--.